US011741810B2

(12) United States Patent
Nemeth

(10) Patent No.: US 11,741,810 B2
(45) Date of Patent: Aug. 29, 2023

(54) BUILDING AUTOMATION EMERGENCY RESPONSE SYSTEM

(71) Applicant: SCHNEIDER ELECTRIC BUILDINGS AMERICAS, INC., Carrollton, TX (US)

(72) Inventor: Kenneth Craig Nemeth, Quebec (CA)

(73) Assignee: Schneider Electric Buildings Americas, Inc., Carrollton, TX (US)

( * ) Notice: Subject to any disclaimer, the term of this patent is extended or adjusted under 35 U.S.C. 154(b) by 90 days.

(21) Appl. No.: 17/124,544

(22) Filed: Dec. 17, 2020

(65) Prior Publication Data

US 2021/0193336 A1 Jun. 24, 2021

Related U.S. Application Data

(60) Provisional application No. 62/950,756, filed on Dec. 19, 2019.

(51) Int. Cl.
*G16Y 40/50* (2020.01)
*G08B 25/10* (2006.01)
(Continued)

(52) U.S. Cl.
CPC ..... *G08B 19/00* (2013.01); *G06Q 90/205* (2013.01); *G08B 25/10* (2013.01); *G16Y 10/80* (2020.01);
(Continued)

(58) Field of Classification Search
CPC ..... G01C 21/3461; G01C 21/206; G05B 15/02; G06Q 90/205; G08B 7/066;
(Continued)

(56) References Cited

U.S. PATENT DOCUMENTS 5,764,142 A * 6/1998 Anderson ..... G01D 3/032 340/630
9,799,205 B2 10/2017 Wedig et al.
(Continued)

FOREIGN PATENT DOCUMENTS

CN 102509410 A 6/2012
JP 2006309456 A 11/2006
(Continued)

OTHER PUBLICATIONS

International Search Report and Written Opinion dated Mar. 25, 2021 for International Patent Application No. PCT/US2020/066080, 9 pages.

*Primary Examiner* — Stephen R Burgdorf
(74) *Attorney, Agent, or Firm* — Locke Lord LLP

(57) ABSTRACT

A server associated with a building automation emergency response system, receives indications of a detected emergency from sensors distributed among zones in the building, comprising a sensor reading level and a sensor identity. The server determines a zone danger level, based on the sensor identity and on the sensor reading levels. The server calculates an evacuation route commencing from user interfaces distributed among the zones. The user interfaces include a display device. The evacuation route is calculated to traverse the zones with a lower route danger level. The evacuation route is directed toward a safe exit, based on a floor plan. The server then transmits a depiction of the evacuation route to the user interfaces for display. The server continues receiving updated indications from the sensors, determines updated route danger levels, calculates an updated evacuation route, and transmits an updated depiction of the evacuation route to the user interfaces for display.

12 Claims, 18 Drawing Sheets

(51) Int. Cl.

| | |
|---|---|
| ***G16Y 20/10*** | (2020.01) |
| ***G16Y 40/10*** | (2020.01) |
| ***G16Y 10/80*** | (2020.01) |
| ***G08B 19/00*** | (2006.01) |
| ***G06Q 90/00*** | (2006.01) |

(52) U.S. Cl.
CPC ..... *G16Y 20/10* (2020.01); *G16Y 40/10* (2020.01); *G16Y 40/50* (2020.01)

(58) Field of Classification Search
CPC ..... G08B 13/1672; G08B 17/10; G08B 19/00; G08B 21/10; G08B 21/182; G08B 25/016; G08B 25/10; G08B 25/14; G08G 1/202; G16Y 10/80; G16Y 20/10; G16Y 40/10; G16Y 40/50
USPC ..... 340/517
See application file for complete search history.

(56) References Cited

U.S. PATENT DOCUMENTS

| | | | | |
|---|---|---|---|---|
| 9,817,383 | B1 | 11/2017 | Sinha et al. | |
| 2010/0004803 | A1* | 1/2010 | Manfredi | B64D 25/00 701/14 |
| 2011/0241877 | A1* | 10/2011 | Wedig | G08B 17/00 340/540 |
| 2013/0169817 | A1* | 7/2013 | Jones | G08B 25/14 340/539.2 |
| 2014/0320282 | A1* | 10/2014 | Zhang | G08B 7/066 340/502 |
| 2016/0123741 | A1* | 5/2016 | Mountain | G08B 7/066 701/533 |
| 2017/0059343 | A1* | 3/2017 | Spinelli | G01C 21/20 |
| 2017/0123391 | A1* | 5/2017 | Sinha | G05B 15/02 |
| 2018/0048998 | A1* | 2/2018 | Mahajan | H04W 4/025 |
| 2018/0160278 | A1* | 6/2018 | Patel | G08B 27/001 |
| 2018/0204428 | A1* | 7/2018 | Asaro | G08B 7/062 |
| 2018/0276485 | A1* | 9/2018 | Heck | G01C 21/3461 |
| 2020/0066140 | A1* | 2/2020 | De Paz Alberola | G08B 17/00 |
| 2020/0226892 | A1* | 7/2020 | Coles | G08B 5/38 |

FOREIGN PATENT DOCUMENTS

| | | | |
|---|---|---|---|
| WO | 2017120260 | A1 | 7/2017 |
| WO | 2017192770 | A1 | 11/2017 |
| WO | 2018080743 | A1 | 5/2018 |
| WO | 2018232147 | A1 | 12/2018 |
| WO | 2019067645 | A1 | 4/2019 |
| WO | 2019111002 | A1 | 6/2019 |

* cited by examiner

SENSORS 124

DISPLAY BY USER INTERFACE UI(2) OF SAFEST EVACUATION ROUTE(B3) FROM ZONE(B) TO AVOID EMERGENCY

DISPLAY BY USER INTERFACE UI(6) OF SAFEST EVACUATION ROUTE(F2) FROM ZONE(F) TO AVOID EMERGENCY

Past + Present

FIRE PREDICTION MAP FOR FIRE IN ZONE(A) WITH 3-MINUTE TIME INCREMENTS FOR SPREADING FIRE

DISPLAY BY USER INTERFACE UI(2) OF SAFEST EVACUATION ROUTE(B3) AT 3 MINUTES INTO FUTURE

DISPLAY BY USER INTERFACE UI(2) OF SAFEST EVACUATION ROUTE(B2) AT 6 MINUTES INTO FUTURE

ACTIVE SHOOTER PREDICTION MAP FOR GUNMAN IN ZONE(A) WITH 30-SECOND TIME INCREMENTS FOR MOVEMENTS

DISPLAY BY USER INTERFACE UI(2) OF SAFEST EVACUATION ROUTE(B2) AT 60 SECONDS INTO FUTURE

BUILDING AUTOMATION EMERGENCY RESPONSE SYSTEM

CROSS REFERENCE TO RELATED APPLICATIONS

This application claims the benefit of and priority to U.S. Provisional Application No. 62/950,756, filed on Dec. 19, 2019 under 35 U.S.C. 119(e), which application is incorporated by reference herein in its entirety.

TECHNICAL FIELD

The present disclosure relates to integrating building automation emergency response systems into building automation systems, and more particularly to dynamically directing occupants to a safe location in the event of an emergency.

BACKGROUND

In the event of an emergency arising in a building, such as an office building, a school building, a theater, or the like, the building's occupants must be quickly directed to a safe evacuation route to exit the building. Possible building emergencies may include fire, explosion, hazardous materials release, natural gas leaks, plumbing failure or flooding, power failure, elevator failure, and medical emergencies. Other types of emergencies perpetrated by actors may include active shooter, bomb threats and suspicious mail, demonstrations or protests, and workplace violence. Any delay in providing safe evacuation route directions to occupants could have potentially disastrous consequences.

SUMMARY

In accordance with one embodiment described herein, a server associated with a building automation emergency response system of a building, receives indications of a detected emergency in the building from one or more sensors distributed among one or more zones in the building. The indications comprise a sensor reading level of the detected emergency and an identity of the one or more sensors. The server determines a zone danger level of the detected emergency in the one or more zones, based on the identity of the one or more sensors indicating a location in the one or more zones, and based on the sensor reading level of the detected emergency of the one or more sensors in the one or more zones. The server calculates a respective evacuation route commencing from one or more user interfaces distributed among the one or more zones in the building. The evacuation route is calculated to traverse one or more zones having respective zone danger levels. A route danger level is computed as a sum of products of distance segments along the route and the respective zone danger level of the zones traversed by the segments. The safest evacuation route is the route that has a minimum route danger level in reaching a respective safe exit location of the building. The server then transmits a depiction of the safest evacuation route to the one or more user interfaces for display on a display device. The server continues receiving updated indications of the detected emergency from the one or more sensors. In response, the server determines updated zone danger levels, updated route danger levels, calculates an updated safest evacuation route commencing from the one or more user interfaces, and transmits an updated depiction of the safest evacuation route to the one or more user interfaces for display, to guide occupants to a safe location in the event of an emergency.

In accordance with an embodiment described herein, the server maintains a record of past indications comprising past instances of sensor reading level of the detected emergency and the identity of the one or more sensors in the one of the one or more zones. The server determines a weight for the past instances of sensor reading level of the detected emergency of the one or more sensors in the one or more zones. The weight is based on how frequently and recently the past instances of sensor reading level of the detected emergency have been detected by the one or more sensors. The server determines a past zone danger level of the detected emergency in the one or more zones, based on the past sensor reading levels of the detected emergency of the one or more sensors in the one or more zones. The server calculates a past-present zone danger level of the one or more zones by adding the present zone sensor level with the past zone danger level of the one or more zones. The server then calculates the safest evacuation route based on the past-present zone danger level of the one or more zones.

In accordance with an embodiment described herein, the server determines a predicted sensor danger level of the detected emergency in the one or more sensors. The predicted sensor danger level is based on a predicted rate of movement of the emergency or on structural or other conditions of the zones. The server determines a predicted zone danger level of the detected emergency in the one or more zones. The predicted zone danger level is based on the predicted sensor danger level of the detected emergency of the one or more sensors in the one or more zones. The server calculates a past-present-predicted zone danger level of the one or more zones by adding the past-present zone danger level with the predicted zone danger level of the one or more zones. The server then calculates the safest evacuation route based on the past-present-predicted zone danger level of the one or more zones.

In accordance with an embodiment described herein, the server determines that the first evacuation route having the first route danger level is safer than the second evacuation route having the second route danger level. The server then transmits a depiction of the safer first evacuation route to a respective one of the one or more user interfaces for display on the display device as the safest evacuation route.

In accordance with an embodiment described the sensor for detecting an emergency is at least one of a gunshot sensor, a fire sensor, an explosion sensor, a hazardous materials release sensor, a natural gas leak sensor, a smoke sensor, a plumbing flooding sensor, a power failure sensor, or an elevator failure sensor.

In accordance with an embodiment described herein, a server, comprises:

at least one processor;

at least one memory, including computer program code, wherein the computer program code, when executed by operation of the at least one processor, causes an operation to be performed, the operation comprising:

receiving, by the server, one or more indications of a detected emergency in a building from one or more sensors distributed among one or more zones in the building, the one or more indications comprising a sensor reading level of the detected emergency and an identity of the one or more sensors;

determining, by the server, one or more zone danger levels of the detected emergency in the one or more zones, based on the identity of the one or more sensors indicating a location in the one or more zones, and based on the sensor reading level of the detected emergency of the one or more sensors in the one or more zones;

calculating, by the server, a route danger level of one or more evacuation routes from one or more user interfaces located in the one or more zones in the building toward one or more respective exit locations of the building, the one or more evacuation routes comprising a sequence of one or more distance segments traversing the one or more zones having respective zone danger levels;

determining, by the server, one or more safest evacuation routes of the one or more evacuation routes from the one or more user interfaces respectively located in the one or more zones, the safest evacuation routes having route danger levels that are less than a route danger level of other ones of the one or more evacuation routes from the respective user interfaces;

transmitting, by the server, one or more depictions of the safest evacuation routes to the one or more user interfaces in the one or more zones for display on one or more display devices, wherein the one or more depictions are of the one or more safest routes transmitted to respective ones of the one or more user interfaces, based on the locations of the respective ones of the one or more user interfaces relative to the one or more exit locations and the detected emergency; and receiving, by the server, updated indications of the detected emergency in the building from the one or more sensors, and in response, determining updated zone danger levels in the one or more zones, calculating updated route danger levels based on the updated zone danger levels, determining updated safest evacuation routes based on the updated route danger levels, and transmitting updated depictions of the safest evacuation routes to the one or more user interfaces for display.

In accordance with an embodiment described herein, the server further comprises:

the at least one memory, including computer program code, wherein the computer program code, when executed by operation of the at least one processor, causes an operation to be performed comprising:

maintaining, by the server, a record of past indications comprising past instances of sensor reading level of the detected emergency and the identity of the one or more sensors in the one of the one or more zones;

determining, by the server, weights for the past instances of sensor reading level of the detected emergency of the one or more sensors in the one or more zones, the weights based on how frequently and recently the past instances of sensor reading level of the detected emergency have been detected by the one or more sensors;

calculating, by the server, a past sensor danger level of the detected emergency in the one or more zones, based on a sum of products of the weights for the past instances of sensor reading level times the past sensor reading levels;

calculating, by the server, a past-present-zone danger level of the one or more zones by adding the received sensor reading level and the past sensor danger level of the one or more zones;

calculating, by the server, a past-present route danger level of one or more evacuation routes from one or more user interfaces located in the one or more zones in the building, based on the past-present-zone danger level of the one or more zones; and determining, by the server, the safest evacuation route of the one or more evacuation routes from the one or more user interfaces located in the one or more zones, based on the past-present route danger level of one or more evacuation routes.

In accordance with an embodiment described herein, the server further comprises:

the at least one memory, including computer program code, wherein the computer program code, when executed by operation of the at least one processor, causes an operation to be performed comprising:

determining, by the server, a predicted sensor danger level of the detected emergency in the one or more sensors, based on a predicted rate of movement of the emergency or on conditions of the zones;

determining, by the server, a predicted zone danger level of the detected emergency in the one or more zones, based on the predicted sensor danger level of the detected emergency of the one or more sensors in the one or more zones;

calculating, by the server, a past-present-predicted zone danger level of the one or more zones by adding the past-present zone danger level and the predicted zone danger level of the one or more zones; and calculating, by the server, the safest evacuation route based on the past-present-predicted zone danger level of the one or more zones.

In accordance with an embodiment described herein, the server further comprises:

the at least one memory, including computer program code, wherein the computer program code, when executed by operation of the at least one processor, causes an operation to be performed comprising:

determining, by the server, a predicted sensor danger level of the detected emergency in the one or more sensors, based on a predicted rate of movement of the emergency or on conditions of the zones;

determining, by the server, a predicted zone danger level of the detected emergency in the one or more zones, based on the predicted sensor danger level of the detected emergency of the one or more sensors in the one or more zones;

calculating, by the server, a present-predicted zone danger level of the one or more zones by adding the present zone danger level and the predicted zone danger level of the one or more zones; and calculating, by the server, the safest evacuation route based on the present-predicted zone danger level of the one or more zones.

In accordance with an embodiment described herein, the server further comprises:

the at least one memory, including computer program code, wherein the computer program code, when executed by operation of the at least one processor, causes an operation to be performed comprising:

calculating, by the server, a first evacuation route commencing from one or more user interfaces distributed among respective ones of the one or more zones in the building, the one or more user interfaces including a display device, the evacuation route calculated to traverse a first sequence of respective ones of the one or more zones having a first route danger level;

calculating, by the server, a second evacuation route commencing from one or more user interfaces distributed among respective ones of the one or more zones in the building, the one or more user interfaces including a display device, the evacuation route calculated to traverse a second sequence of respective ones of the one or more zones having a second route danger level;

determining, by the server, that the first evacuation route having the first route danger level is safer than the second evacuation route having the second route danger level; and transmitting, by the server, a depiction of the first evacuation route to a respective one of the one or more user interfaces for display on the display device as the safest evacuation route.

In accordance with an embodiment described herein, the server further comprises:

the at least one memory, including computer program code, wherein the computer program code, when executed by operation of the at least one processor, causes an operation to be performed comprising:

calculating, by the server, the safest evacuation route, based at least on one of [1] avoiding where the emergency has been located and is currently located, or [2] avoiding where the emergency is predicted to be located.

In accordance with an embodiment described herein, the server further comprises:

wherein when the sensor for detecting an emergency is at least one of a gunshot sensor, a fire sensor, an explosion sensor, a hazardous materials release sensor, a natural gas leak sensor, a smoke sensor, a plumbing flooding sensor, a power failure sensor, or an elevator failure sensor.

In accordance with an embodiment described herein, a computer program product comprising computer executable program code recorded on a computer readable non-transitory storage medium, the computer executable program code comprises:

code for receiving, by the server, one or more indications of a detected emergency in a building from one or more sensors distributed among one or more zones in the building, the one or more indications comprising a sensor reading level of the detected emergency and an identity of the one or more sensors;

code for determining, by the server, one or more zone danger levels of the detected emergency in the one or more zones, based on the identity of the one or more sensors indicating a location in the one or more zones, and based on the sensor reading level of the detected emergency of the one or more sensors in the one or more zones;

code for calculating, by the server, a route danger level of one or more evacuation routes from one or more user interfaces located in the one or more zones in the building toward one or more respective exit locations of the building, the one or more evacuation routes comprising a sequence of one or more distance segments traversing the one or more zones having respective zone danger levels;

code for determining, by the server, one or more safest evacuation routes of the one or more evacuation routes from the one or more user interfaces respectively located in the one or more zones, the safest evacuation routes having route danger levels that are less than a route danger level of other ones of the one or more evacuation routes from the respective user interfaces;

code for transmitting, by the server, a one or more depictions of the safest evacuation routes to the one or more user interfaces in the one or more zones for display on a one or more display devices, wherein the one or more depictions are of the one or more safest routes transmitted to respective ones of the one or more user interfaces, based on the locations of the respective ones of the one or more user interfaces relative to the one or more exit locations and the detected emergency; and code for receiving, by the server, updated indications of the detected emergency in the building from the one or more sensors, and in response, determining updated zone danger levels in the one or more zones, calculating updated route danger levels based on the updated zone danger levels, determining updated safest evacuation routes based on the updated route danger levels, and transmitting updated depictions of the safest evacuation routes to the one or more user interfaces for display.

In accordance with an embodiment described herein, the computer program product further comprises:

code for maintaining, by the server, a record of past indications comprising past instances of sensor reading level of the detected emergency and the identity of the one or more sensors in the one of the one or more zones;

code for determining, by the server, weights for the past instances of sensor reading level of the detected emergency of the one or more sensors in the one or more zones, the weights based on how frequently and recently the past instances of sensor reading level of the detected emergency have been detected by the one or more sensors;

code for calculating, by the server, a past sensor danger level of the detected emergency in the one or more zones, based on a sum of products of the weights for the past instances of sensor reading level times the past sensor reading levels;

code for calculating, by the server, a past-present-zone danger level of the one or more zones by adding the received sensor reading level and the past sensor danger level of the one or more zones;

code for calculating, by the server, a past-present route danger level of one or more evacuation routes from one or more user interfaces located in the one or more zones in the building, based on the past-present-zone danger level of the one or more zones; and code for determining, by the server, the safest evacuation route of the one or more evacuation routes from the one or more user interfaces located in the one or more zones, based on the past-present route danger level of one or more evacuation routes.

In accordance with an embodiment described herein, the computer program product further comprises:

code for determining, by the server, a predicted sensor danger level of the detected emergency in the one or more sensors, based on a predicted rate of movement of the emergency or on conditions of the zones;

code for determining, by the server, a predicted zone danger level of the detected emergency in the one or more zones, based on the predicted sensor danger level of the detected emergency of the one or more sensors in the one or more zones;

code for calculating, by the server, a past-present-predicted zone danger level of the one or more zones by adding the past-present zone danger level and the predicted zone danger level of the one or more zones; and code for calculating, by the server, the safest evacuation route based on the past-present-predicted zone danger level of the one or more zones.

In accordance with an embodiment described herein, the computer program product further comprises:

code for determining, by the server, a predicted sensor danger level of the detected emergency in the one or more sensors, based on a predicted rate of movement of the emergency or on conditions of the zones;

code for determining, by the server, a predicted zone danger level of the detected emergency in the one or more zones, based on the predicted sensor danger level of the detected emergency of the one or more sensors in the one or more zones;

code for calculating, by the server, a present-predicted zone danger level of the one or more zones by adding the present zone danger level and the predicted zone danger level of the one or more zones; and code for calculating, by the server, the safest evacuation route based on the present-predicted zone danger level of the one or more zones.

In accordance with an embodiment described herein, the computer program product further comprises:

code for calculating, by the server, a first evacuation route commencing from one or more user interfaces distributed among respective ones of the one or more zones in the building, the one or more user interfaces including a display device, the evacuation route calculated to traverse a first sequence of respective ones of the one or more zones having a first route danger level;

code for calculating, by the server, a second evacuation route commencing from one or more user interfaces distributed among respective ones of the one or more zones in the building, the one or more user interfaces including a display device, the evacuation route calculated to traverse a second sequence of respective ones of the one or more zones having a second route danger level;

code for determining, by the server, that the first evacuation route having the first route danger level is safer than the second evacuation route having the second route danger level; and code for transmitting, by the server, a depiction of the first evacuation route to a respective one of the one or more user interfaces for display on the display device as the safest evacuation route.

In accordance with an embodiment described herein, the computer program product further comprises:

code for calculating, by the server, the safest evacuation route, based at least on one of [1] avoiding where the emergency has been located and is currently located, or [2] avoiding where the emergency is predicted to be located.

In accordance with an embodiment described herein, the computer program product further comprises:

wherein when the sensor for detecting an emergency is at least one of a gunshot sensor, a fire sensor, an explosion sensor, a hazardous materials release sensor, a natural gas leak sensor, a smoke sensor, a plumbing flooding sensor, a power failure sensor, or an elevator failure sensor.

In accordance with an embodiment described herein, a method, comprises:

receiving, by the server, one or more indications of a detected emergency in a building from one or more sensors distributed among one or more zones in the building, the one or more indications comprising a sensor reading level of the detected emergency and an identity of the one or more sensors;

determining, by the server, one or more zone danger levels of the detected emergency in the one or more zones, based on the identity of the one or more sensors indicating a location in the one or more zones, and based on the sensor reading level of the detected emergency of the one or more sensors in the one or more zones;

calculating, by the server, a route danger level of one or more evacuation routes from one or more user interfaces located in the one or more zones in the building toward one or more respective exit locations of the building, the one or more evacuation routes comprising a sequence of one or more distance segments traversing the one or more zones having respective zone danger levels;

determining, by the server, one or more safest evacuation routes of the one or more evacuation routes from the one or more user interfaces respectively located in the one or more zones, the safest evacuation routes having route danger levels that are less than a route danger level of other ones of the one or more evacuation routes from the respective user interfaces;

transmitting, by the server, a one or more depictions of the safest evacuation routes to the one or more user interfaces in the one or more zones for display on a one or more display devices, wherein the one or more depictions are of the one or more safest routes transmitted to respective ones of the one or more user interfaces, based on the locations of the respective ones of the one or more user interfaces relative to the one or more exit locations and the detected emergency; and receiving, by the server, updated indications of the detected emergency in the building from the one or more sensors, and in response, determining updated zone danger levels in the one or more zones, calculating updated route danger levels based on the updated zone danger levels, determining updated safest evacuation routes based on the updated route danger levels, and transmitting updated depictions of the safest evacuation routes to the one or more user interfaces for display.

In accordance with an embodiment described herein, the method further comprises:

maintaining, by the server, a record of past indications comprising past instances of sensor reading level of the detected emergency and the identity of the one or more sensors in the one of the one or more zones;

determining, by the server, weights for the past instances of sensor reading level of the detected emergency of the one or more sensors in the one or more zones, the weights based on how frequently and recently the past instances of sensor reading level of the detected emergency have been detected by the one or more sensors;

calculating, by the server, a past sensor danger level of the detected emergency in the one or more zones, based on a sum of products of the weights for the past instances of sensor reading level times the past sensor reading levels;

calculating, by the server, a past-present-zone danger level of the one or more zones by adding the received sensor reading level and the past sensor danger level of the one or more zones;

calculating, by the server, a past-present route danger level of one or more evacuation routes from one or more user interfaces located in the one or more zones in the building, based on the past-present-zone danger level of the one or more zones; and determining, by the server, the safest evacuation route of the one or more evacuation routes from the one or more user interfaces located in the one or more zones, based on the past-present route danger level of one or more evacuation routes;

determining, by the server, a predicted sensor danger level of the detected emergency in the one or more sensors, based on a predicted rate of movement of the emergency or on conditions of the zones;

determining, by the server, a predicted zone danger level of the detected emergency in the one or more zones, based on the predicted sensor danger level of the detected emergency of the one or more sensors in the one or more zones;

calculating, by the server, a past-present-predicted zone danger level of the one or more zones by adding the past-present zone danger level and the predicted zone danger level of the one or more zones; and calculating, by the server, the safest evacuation route based on the past-present-predicted zone danger level of the one or more zones.

In accordance with an embodiment described herein, the method further comprises:

determining, by the server, a predicted sensor danger level of the detected emergency in the one or more sensors, based on a predicted rate of movement of the emergency or on conditions of the zones;

determining, by the server, a predicted zone danger level of the detected emergency in the one or more zones, based on the predicted sensor danger level of the detected emergency of the one or more sensors in the one or more zones;

calculating, by the server, a present-predicted zone danger level of the one or more zones by adding the present zone danger level and the predicted zone danger level of the one or more zones; and calculating, by the server, the safest evacuation route based on the present-predicted zone danger level of the one or more zones.

In accordance with an embodiment described herein, the method further comprises:

calculating, by the server, a first evacuation route commencing from one or more user interfaces distributed among respective ones of the one or more zones in the building, the one or more user interfaces including a display device, the evacuation route calculated to traverse a first sequence of respective ones of the one or more zones having a first route danger level;

calculating, by the server, a second evacuation route commencing from one or more user interfaces distributed among respective ones of the one or more zones in the building, the one or more user interfaces including a display device, the evacuation route calculated to traverse a second sequence of respective ones of the one or more zones having a second route danger level;

determining, by the server, that the first evacuation route having the first route danger level is safer than the second evacuation route having the second route danger level; and transmitting, by the server, a depiction of the first evacuation route to a respective one of the one or more user interfaces for display on the display device as the safest evacuation route.

In accordance with an embodiment described herein, the method further comprises:

wherein when the sensor for detecting an emergency is at least one of a gunshot sensor, a fire sensor, an explosion sensor, a hazardous materials release sensor, a natural gas leak sensor, a smoke sensor, a plumbing flooding sensor, a power failure sensor, or an elevator failure sensor.

In accordance with an embodiment described herein, the server further comprises:

wherein the server calculates the route danger level as a sum of products of the one or more distance segments times the respective zone danger levels of the one or more zones traversed.

The resulting method, apparatus, system, and computer program product integrates building automation emergency response and occupant evacuation systems into building automation systems to dynamically direct occupants to a safe location in the event of an emergency.

BRIEF DESCRIPTION OF THE DRAWINGS

A more detailed description of the disclosure, briefly summarized above, may be had by reference to various embodiments, some of which are illustrated in the appended drawings. While the appended drawings illustrate select embodiments of this disclosure, these drawings are not to be considered limiting of its scope, for the disclosure may admit to other equally effective embodiments.

2A, and showing the safest evacuation route ROUTE(F2) from Zone(F), to avoid the emergency detected in Zone (A) and Zone(N).

Figure 3A:
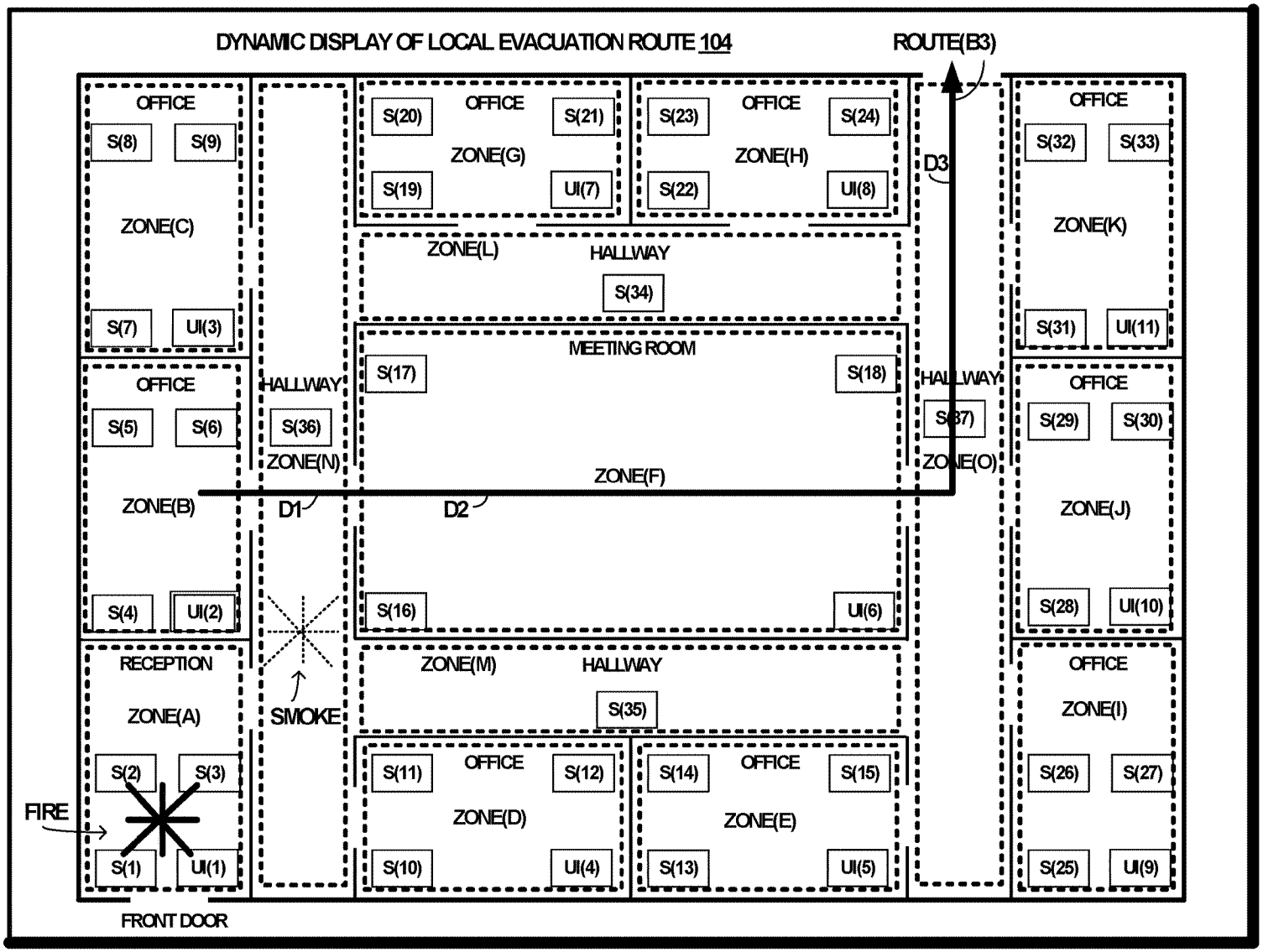
FIG. 3A is an example display on the user interface UI(2) in Zone(B) showing the floor plan of the building of FIG. 2A, and showing the safest evacuation route ROUTE(B3) from Zone(B), to avoid the emergency detected in Zone (A) and Zone(N).
Figure 3B:
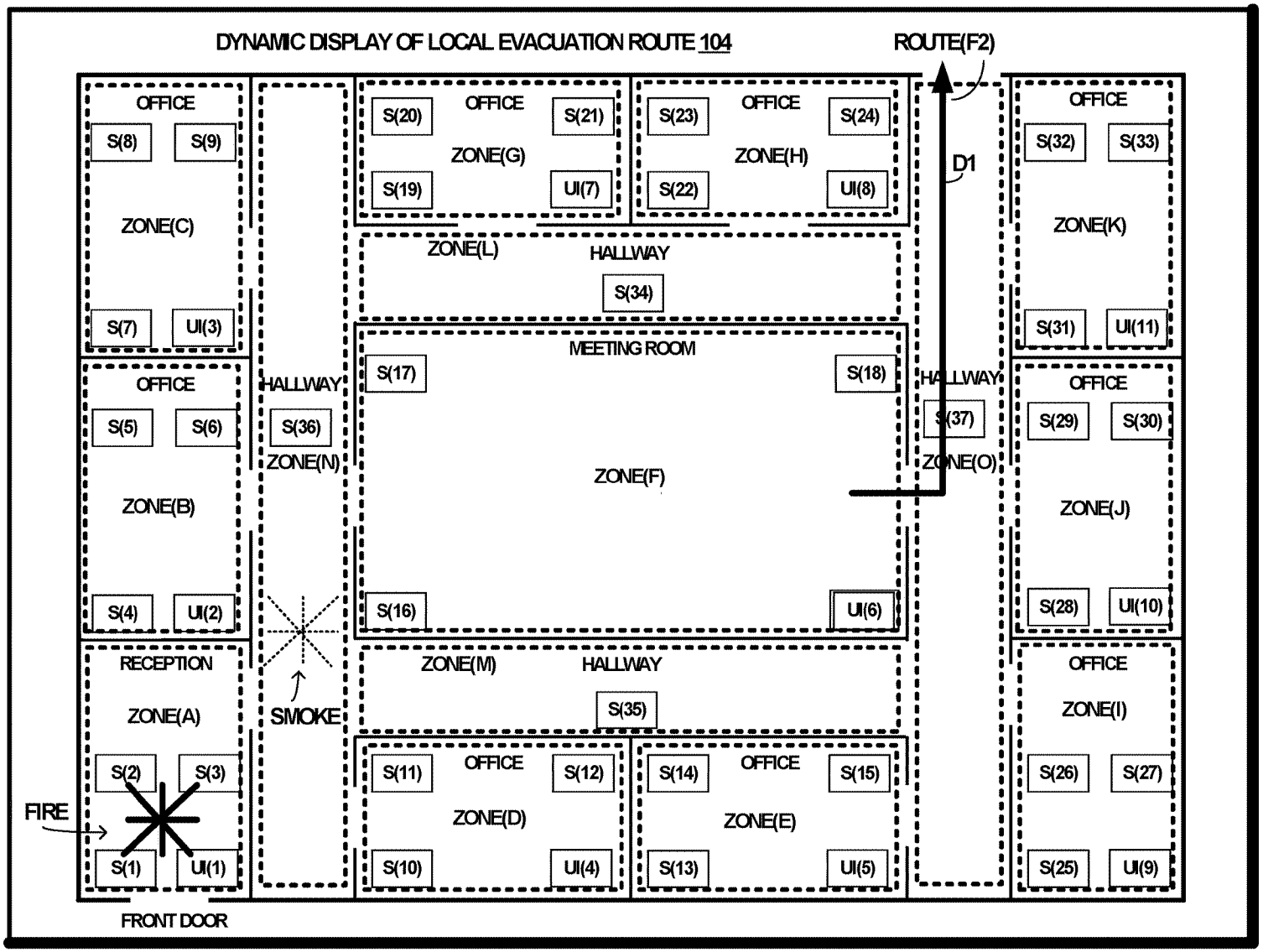
FIG. 3B is an example display on the user interface UI(6) in Zone(F) showing the floor plan of the building of FIG.
Figure 3C:
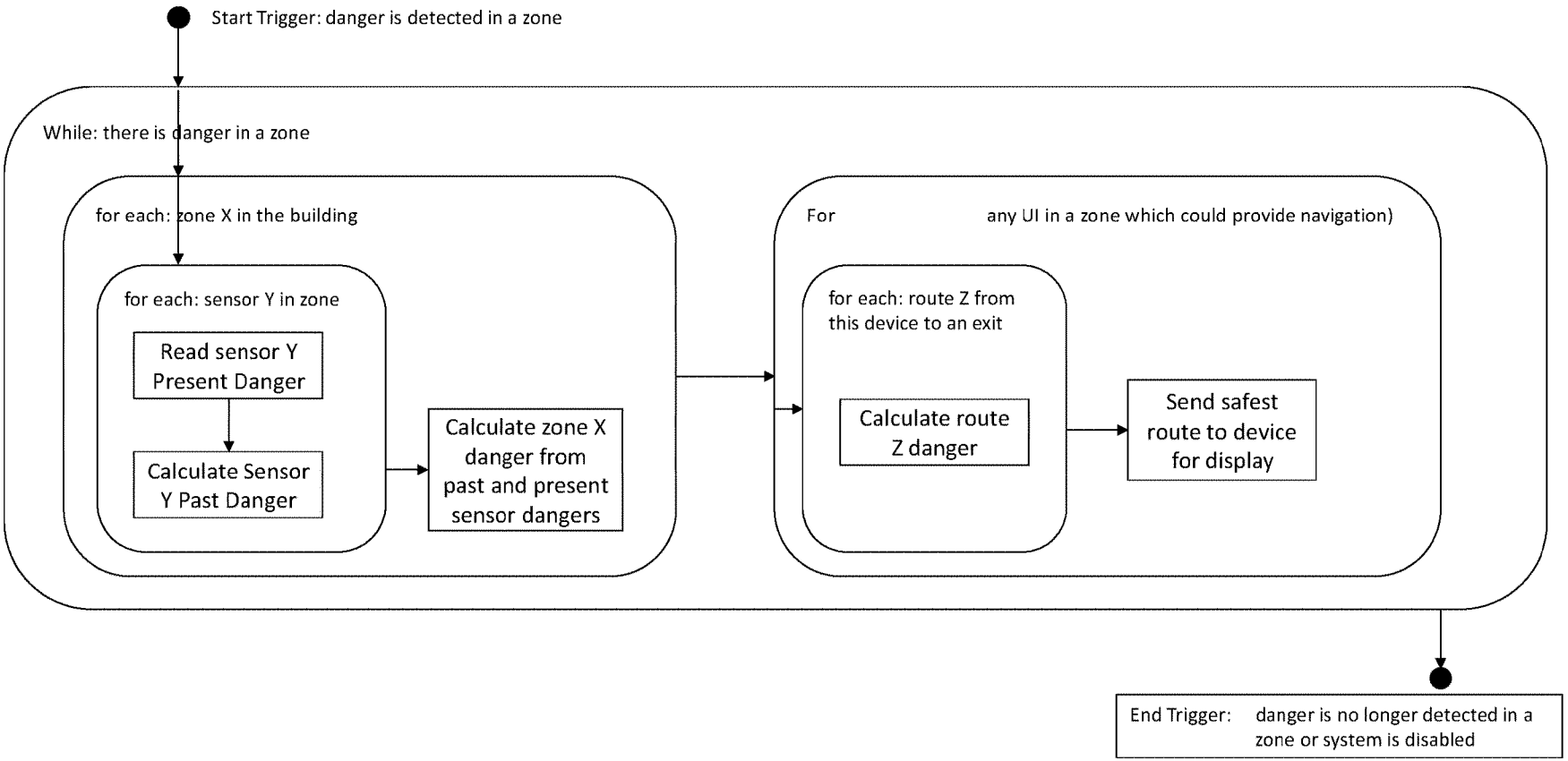

FIG. 3C is an example flow diagram of an example method for computing past-present zone danger level of a zone, according to an embodiment of the disclosure.

Figure 2:
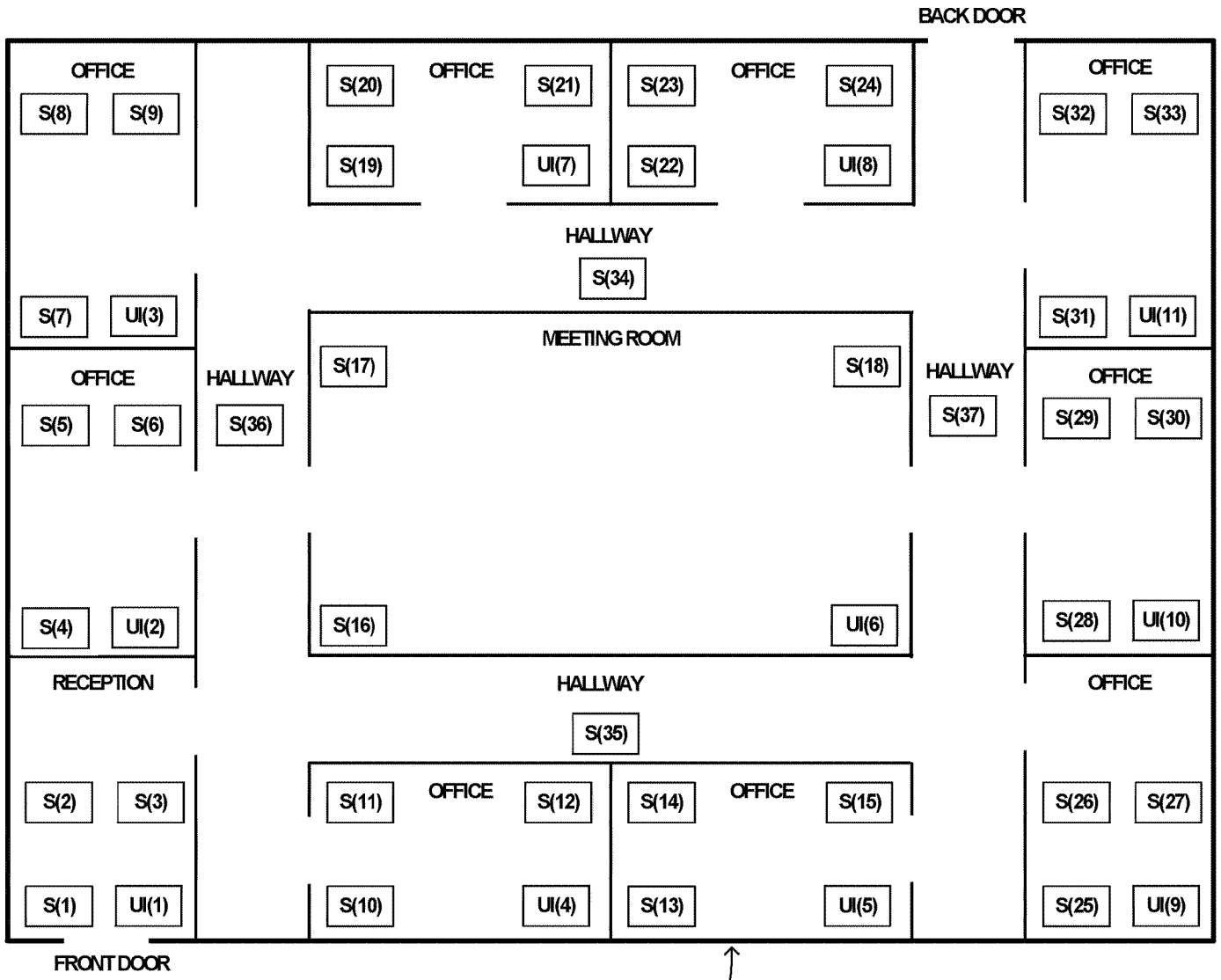
FIG. 2 is an example plan view of the floor plan of the building, including sensors and user interfaces distributed in the building, according to an embodiment of the disclosure.
Figure 4:
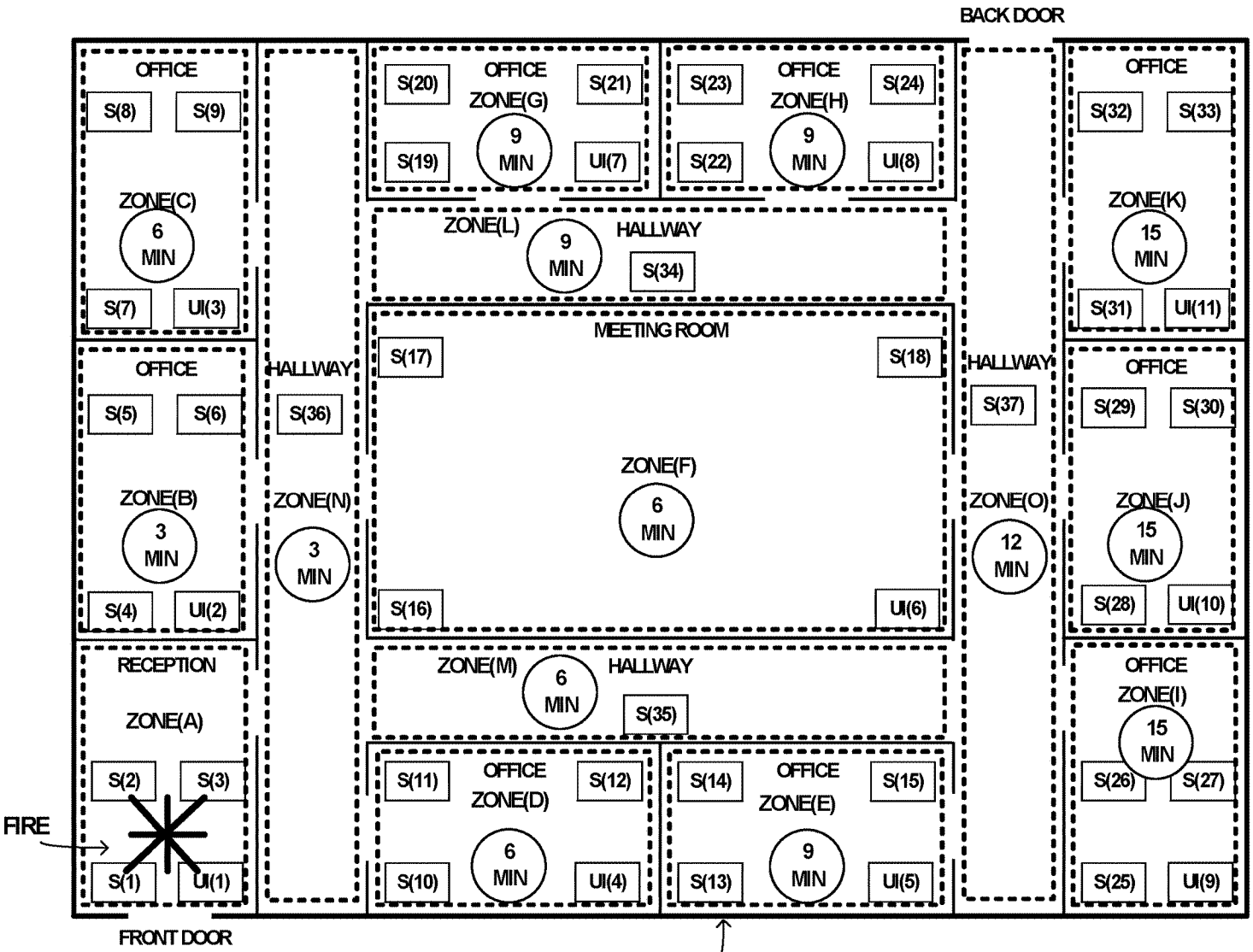

FIG. 4 is an example plan view of the floor plan of the building of FIG. 2, showing a fire prediction map for fire in Zone(A) with 30-second time increments for spreading the fire to other zones, according to an embodiment of the disclosure.

Figure 4A:
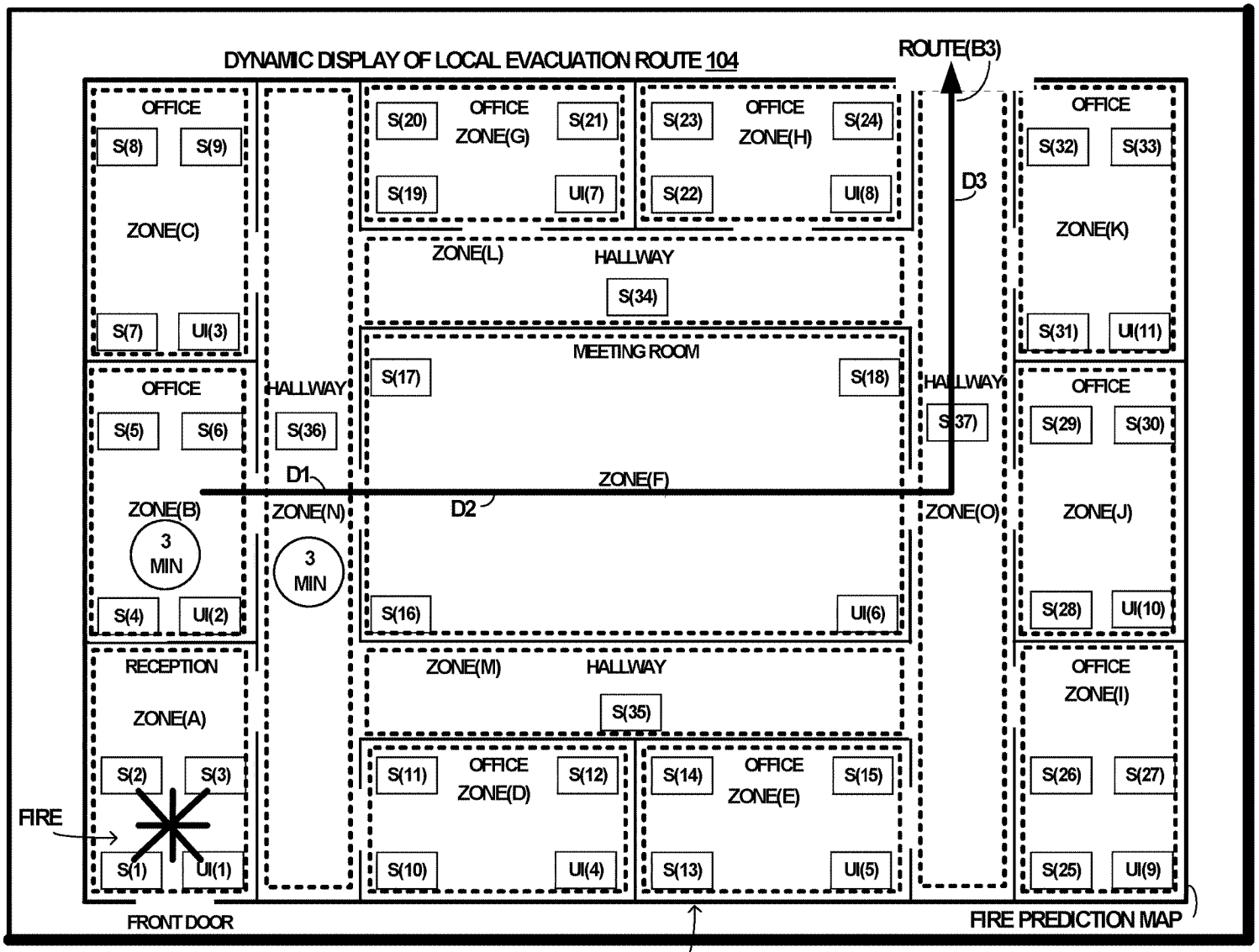

FIG. 4A is an example display on the user interface UI(2) in Zone(B) showing the display by user interface UI(2) of the safest evacuation ROUTE(B3) from Zone(B) at 30 seconds into the future, according to an embodiment of the disclosure.

Figure 4B:
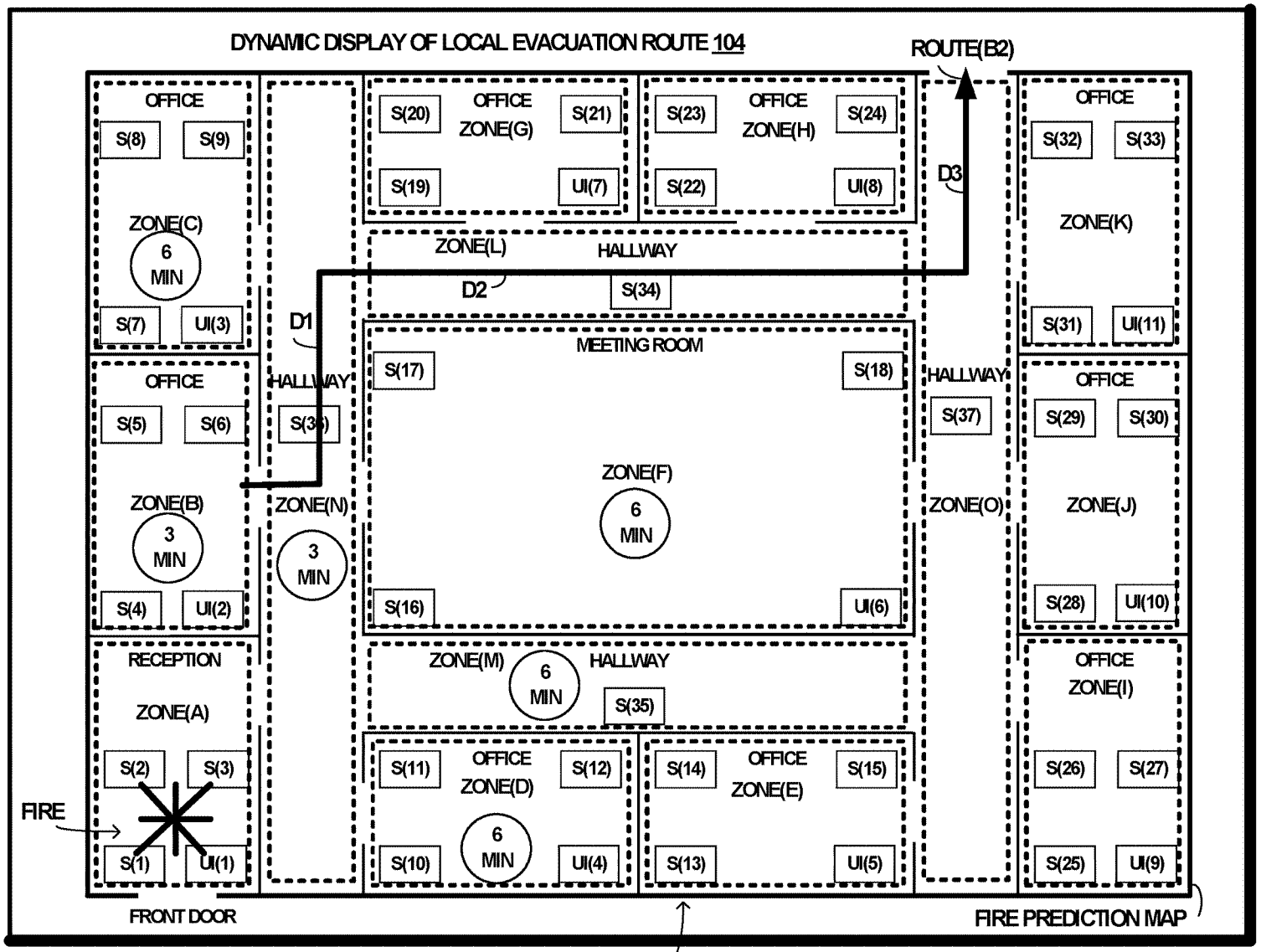

FIG. 4B is an example display on the user interface UI(2) in Zone(B) showing the display by user interface UI(2) of the safest evacuation ROUTE(B2) from Zone(B) at 60 seconds into the future, according to an embodiment of the disclosure.

Figure 4C:
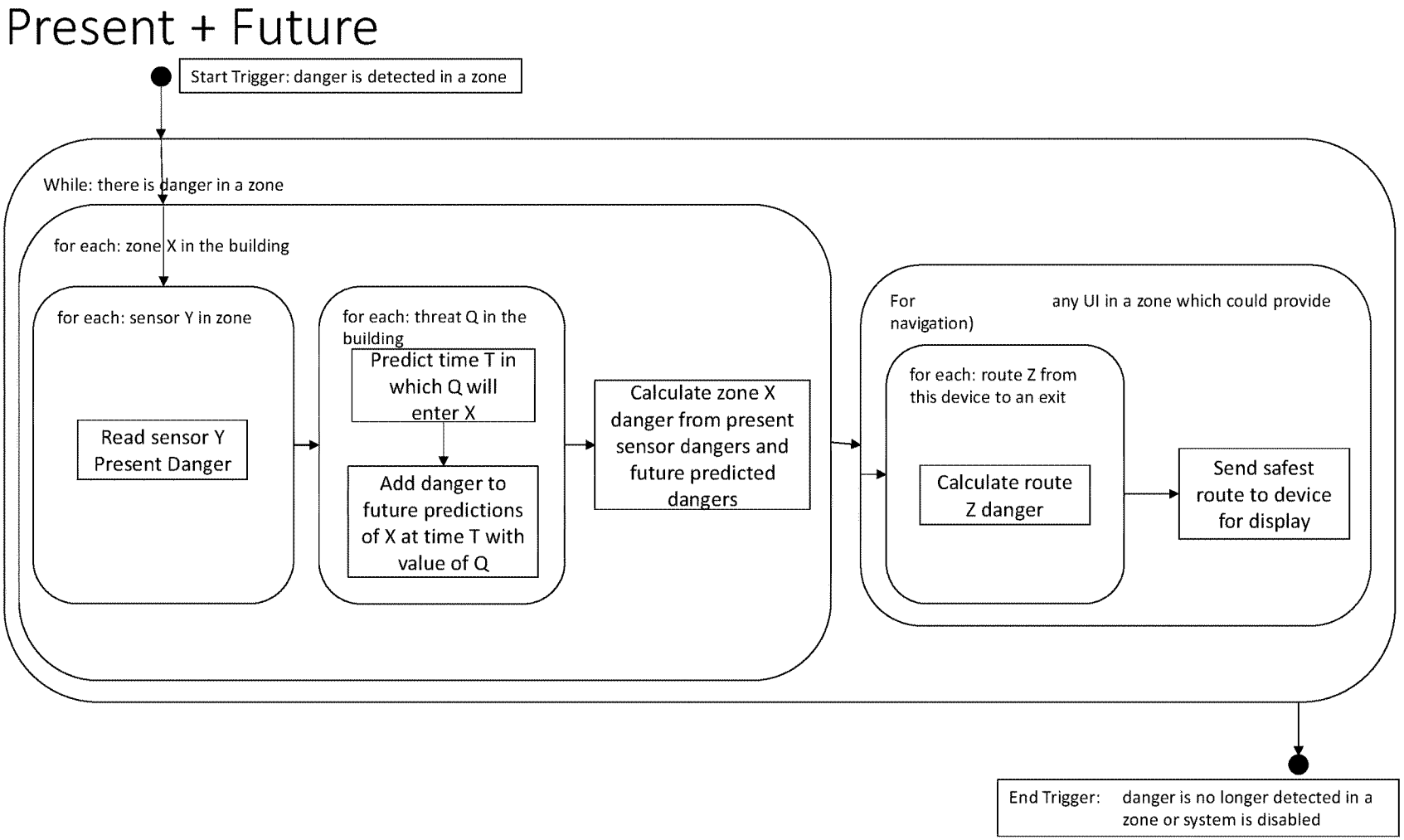

FIG. 4C is an example flow diagram of an example method for computing present-predicted (future) zone danger level of a zone, according to an embodiment of the disclosure.

Figure 4D:
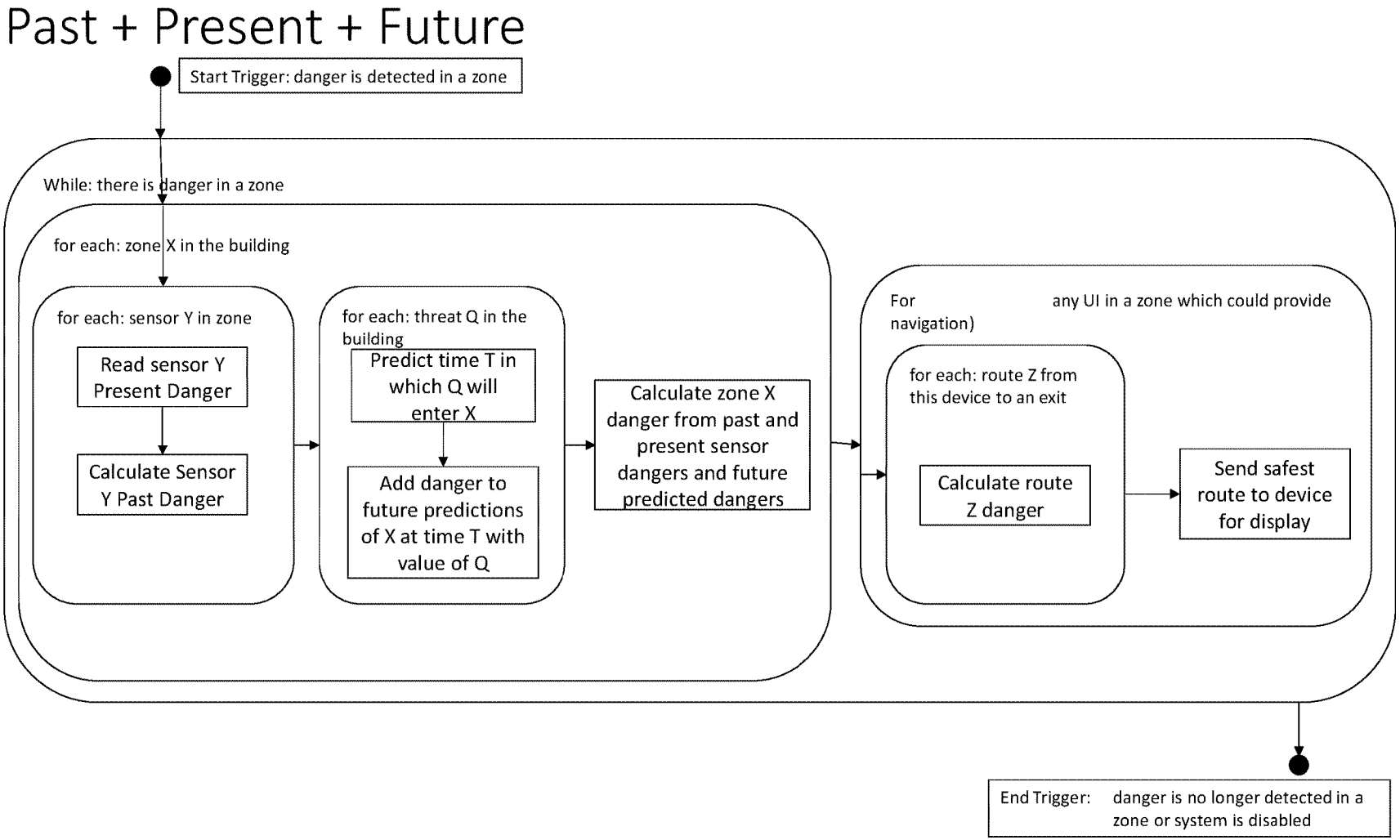

FIG. 4D is an example flow diagram of an example method for computing past-present-predicted (future) zone danger level of a zone, according to an embodiment of the disclosure.

Figure 5:
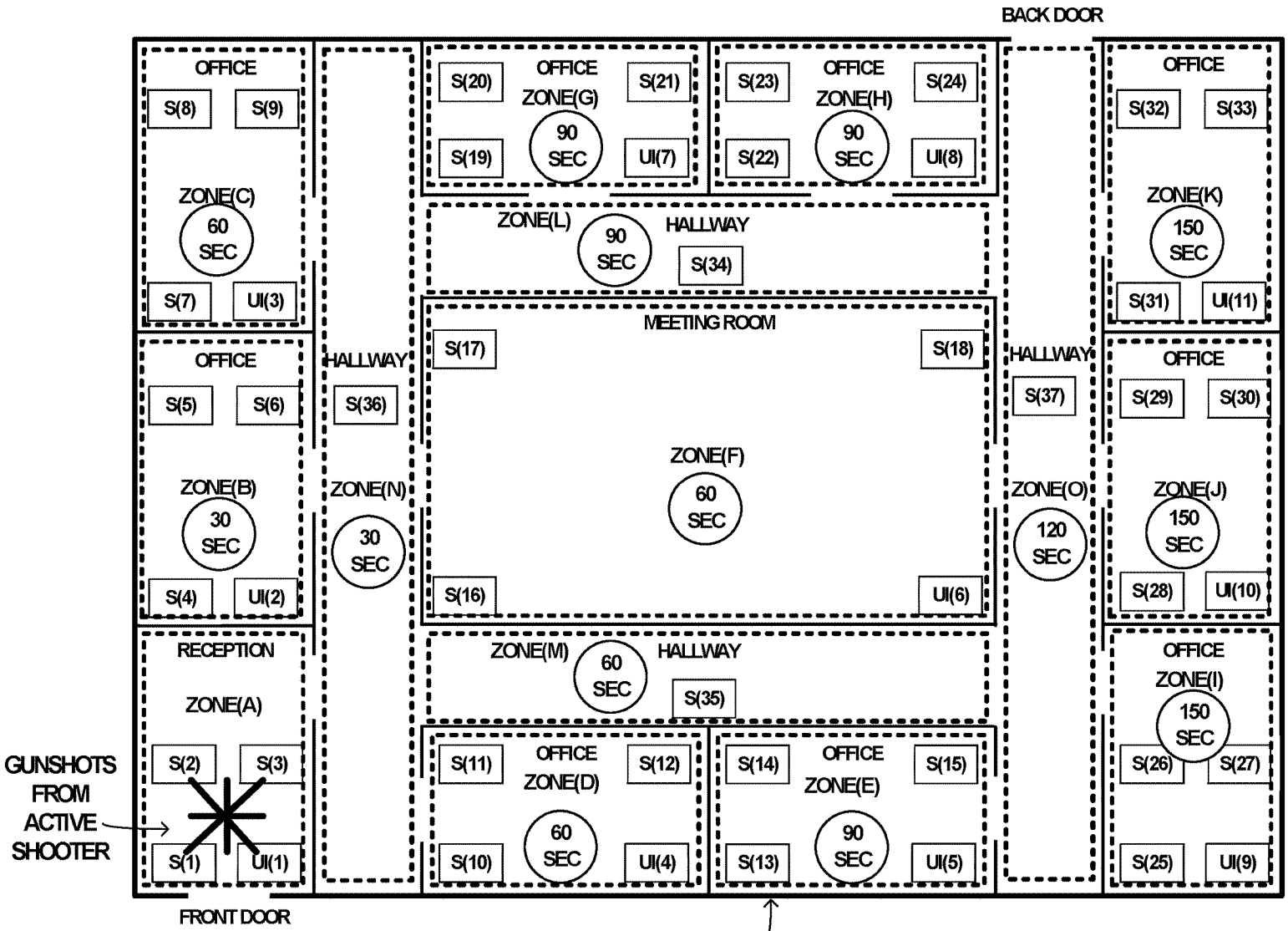

FIG. 5 is an example plan view of the floor plan of the building of FIG. 2, showing an active shooter prediction map for a gunman in Zone(A) with 3-minute time increments for movements of the gunman to other zones, according to an embodiment of the disclosure.

Figure 5A:
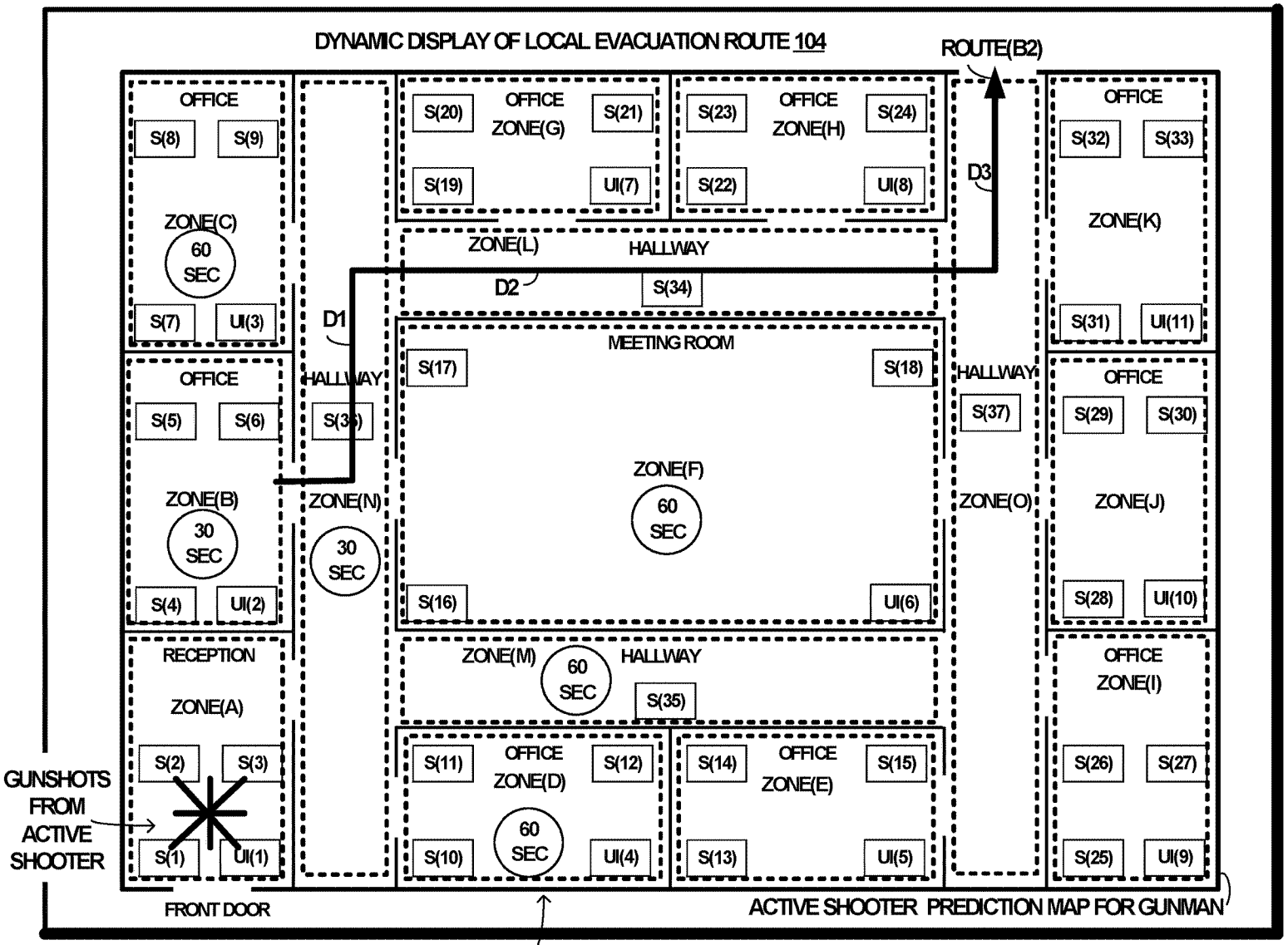

FIG. 5A is an example display on the user interface UI(2) in Zone(B) showing the display by user interface UI(2) of the active shooter prediction map, showing the safest evacuation ROUTE(B2) from Zone(B) at 6 minutes into the future, according to an embodiment of the disclosure.

Figure 1:
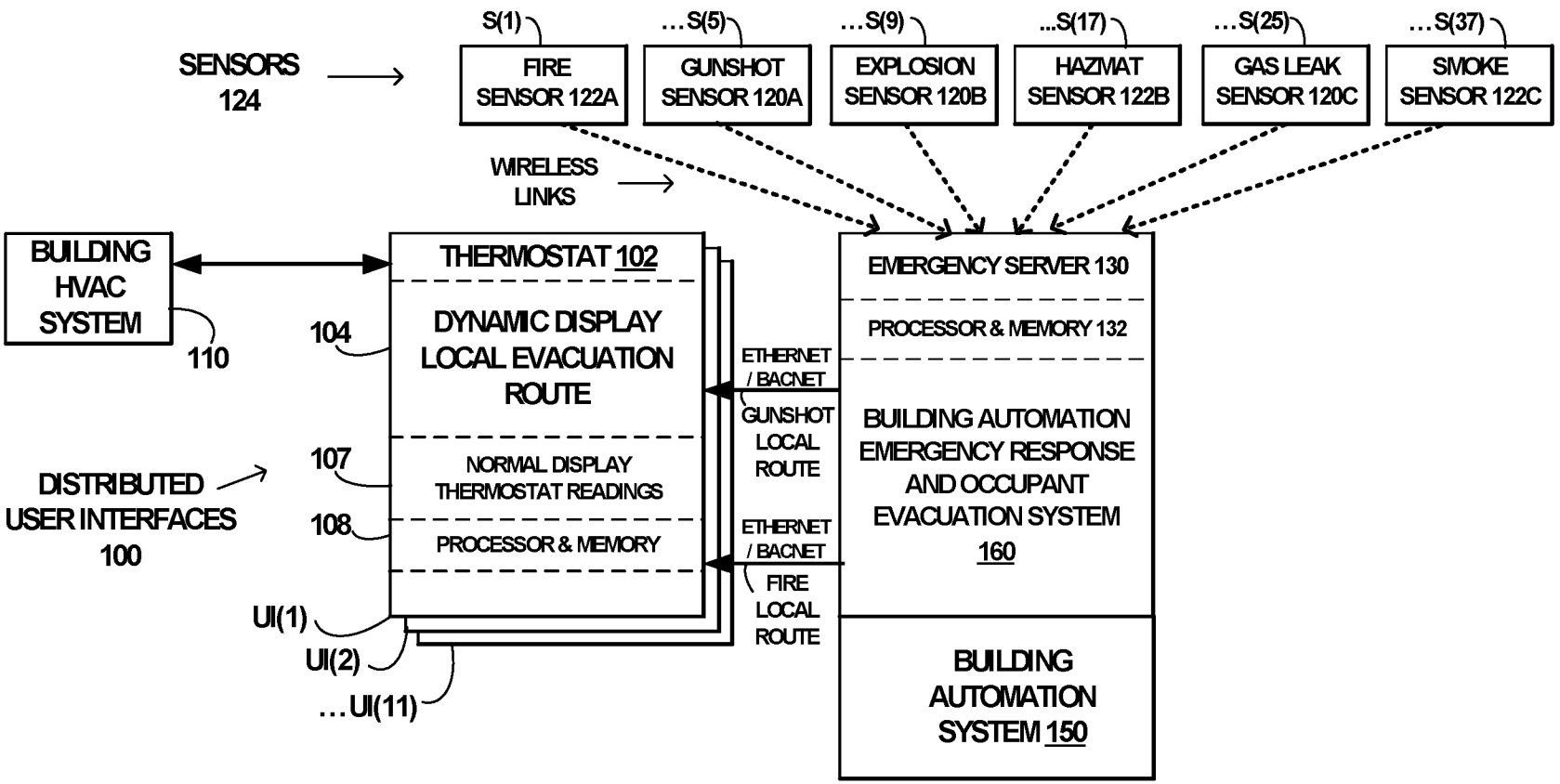
FIG. 1 is an example network and functional block diagram of a building automation emergency response and occupant evacuation system integrated into a building automation system, having sensor inputs directed to the server, to dynamically guide occupants to a safe location in the event of an emergency, according to an embodiment of the disclosure.
Figure 6:
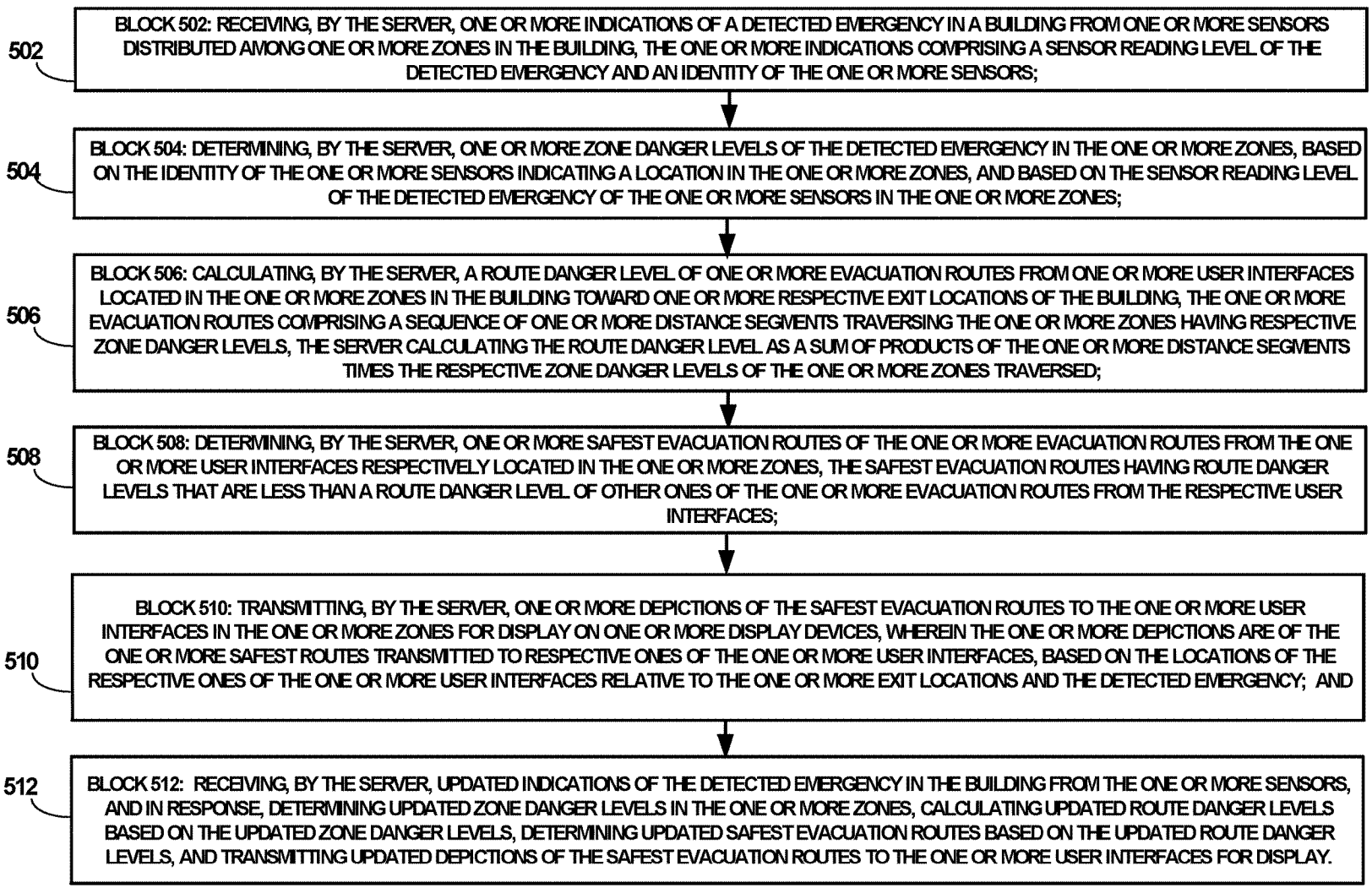

FIG. 6 is an example flow diagram of a method performed by the example building automation emergency response and occupant evacuation system of FIG. 1, according to an embodiment of the disclosure.

Identical reference numerals have been used, where possible, to designate identical elements that are common to the figures. However, elements disclosed in one embodiment may be beneficially utilized on other embodiments without specific recitation.

DETAILED DESCRIPTION

What is needed is a way to integrate building automation emergency response and occupant evacuation systems into building automation systems to dynamically direct occupants to a safe location in the event of an emergency.

FIG. 1 is an example network and functional block diagram of a building automation emergency response and occupant evacuation system 160 integrated into a building automation system 150 of a building, such as an office building, a school building, a theater, or the like. The building automation emergency response and occupant evacuation system 160 may be computer program code residing in at least one memory 132 of the emergency server 130, which when executed by operation of at least one processor in the emergency server 130, carries out the operations of the building automation emergency response and occupant evacuation system 160. In another embodiment, the building automation emergency response and occupant evacuation system 160 may be logic blocks implemented by computer hardware logic in the emergency server 130, which may carry out the functions specified by the logic blocks. The emergency server 130 may reside in the same building as the building automation system 150 or it may be a cloud server accessed over a communications medium.

In the embodiment of FIG. 1, the emergency server 130 is connected by wired or wireless links to one or more sensors 124 distributed throughout the building, such as gunshot sensors 120A, fire sensors 122A, explosion sensors 120B, hazardous materials release sensors 122B, natural gas leak sensors 120C, smoke sensors 122C, and other types of sensors 124, such as plumbing failure or flooding sensors, power failure sensors, elevator failure sensors, and the like. The building automation emergency response and occupant evacuation system 160 in the emergency server 130 determines that an emergency has occurred in the building, based on detection of the emergency by one or more of the sensors 124 distributed at respective locations in the building. FIG. 2 is an example plan view of the floor plan of the building, including the sensors 124 labeled S(1), S(2), . . . S(37), distributed throughout the building. The building automation emergency response and occupant evacuation system 160 in the emergency server 130, receives present indications of a detected emergency in the building from one or more sensors 124. The present indications comprise a present sensor reading level of the detected emergency and an identity of the one or more sensors. The building automation emergency response and occupant evacuation system 160 may continuously monitor the one or more sensors 124 for present indications of a detected emergency in the building.

In the embodiment of FIG. 1, the emergency server 130 is connected by communication links such as ethernet, bacnet, or other wired or wireless links to one or more user interfaces 100 distributed throughout the building. The user interfaces may include, for example, thermostats 102 connected to the building's HVAC system 110, the thermostats including a two-dimensional pictorial display device 107 and a processor and memory 108. Other example user interfaces 100 may include public announcement devices connected to the building's public address system and including a two-dimensional pictorial display device, a processor and memory, televised advertising displays connected to the building's communication system, televised news broadcasting displays connected to the building's communication system, or other wired or wireless display devices including a two-dimensional pictorial display device, a processor and memory connected to the building's communication system. FIG. 2 is an example plan view of the floor plan of the building, including the user interfaces 100 labeled UI(1), UI(2), . . . UI(11), distributed throughout the building. In the event of an emergency, the building automation emergency response and occupant evacuation system 160 calculates a respective evacuation route commencing from the one or more user interfaces 100 distributed throughout the building, toward a safe exit. The user interfaces include a display device 107. The building automation emergency response and occupant evacuation system 160 transmits a depiction of an evacuation route, such as shown in FIG. 3A and FIG. 3B, to the user interfaces 100 for display on the display device 107.

Figure 1A:
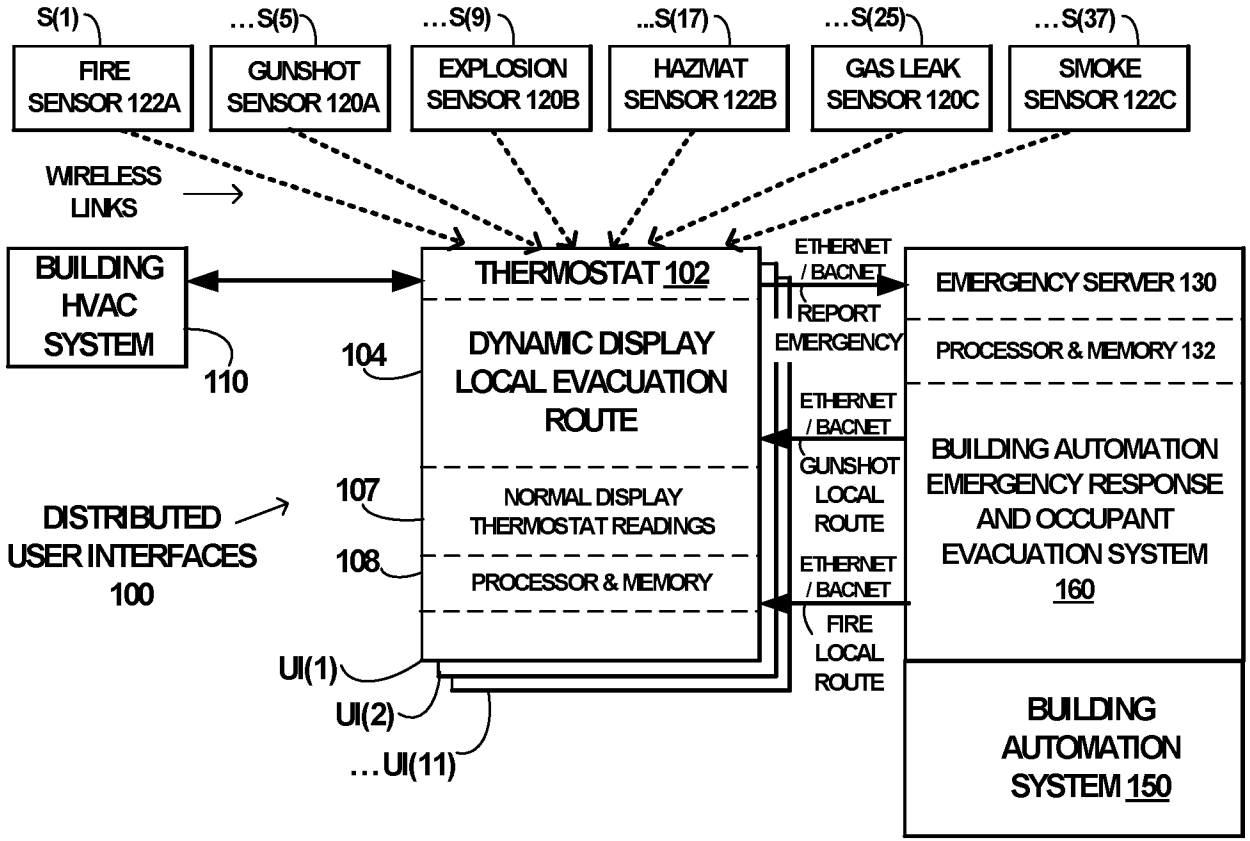
FIG. 1A is an example network and functional block diagram of another embodiment of the building automation emergency response and occupant evacuation system integrated into the building automation system of FIG. 1, having the sensor inputs directed to the user interface, according to an embodiment of the disclosure.

FIG. 1A is an example network and functional block diagram of another embodiment of the building automation emergency response and occupant evacuation system 160 integrated into the building automation system 150 of FIG. 1, having the sensor 124 inputs directed to the user interface 100, such as thermostats 102, according to an embodiment of the disclosure. The thermostats 102 may be connected to the building's HVAC system 110. The thermostats 102 receive present indications of a detected emergency in the building from one or more sensors 124, comprising a present sensor reading level of the detected emergency and an identity of the one or more sensors. The thermostats report the emergency to the building automation emergency response and occupant evacuation system 160. The building automation emergency response and occupant evacuation system 160 transmits a depiction of an evacuation route, such as shown in FIG. 3A and FIG. 3B, to the user interfaces 100 for display on the display device 107.

Figure 1B:
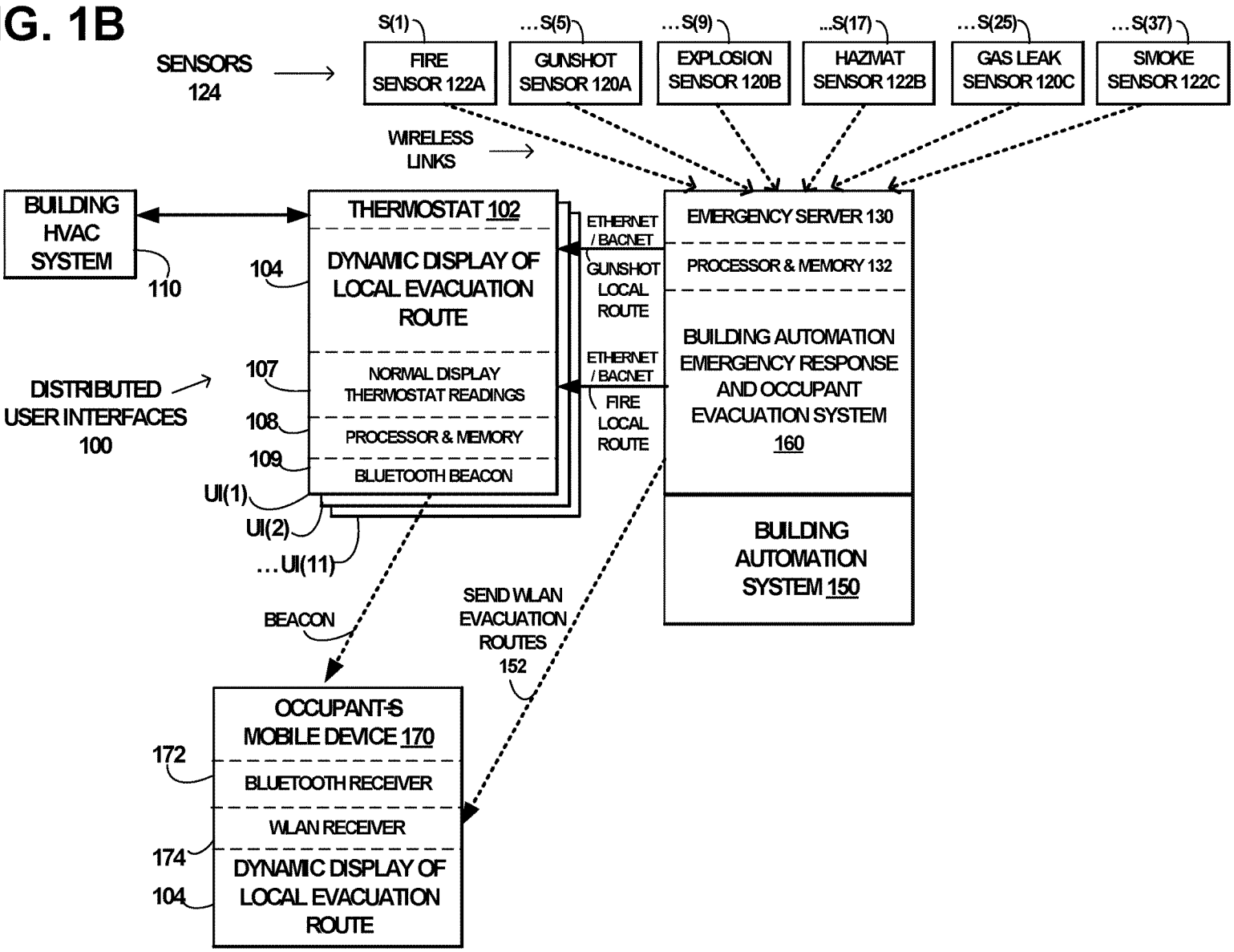
FIG. 1B is an example network and functional block diagram of another embodiment of the building automation emergency response and occupant evacuation system integrated into the building automation system of FIG. 1, wherein the evacuation route is displayed on the occupant's mobile wireless device, according to an embodiment of the disclosure.

FIG. 1B is an example network and functional block diagram of another embodiment of the building automation emergency response and occupant evacuation system 160 integrated into the building automation system 150 of FIG. 1, wherein the evacuation route is displayed on the occupant's mobile wireless device 170, according to an embodiment of the disclosure. The building automation emergency response and occupant evacuation system 160 transmits, for example over a wireless local area network (WLAN) 152 to a WLAN receiver 174, a depiction of an evacuation route, such as shown in FIG. 3A and FIG. 3B, to the occupant's mobile wireless device 170 for display on the display 104 of the wireless device. The occupant's mobile wireless device 170 may be triggered to display the depiction of the evacuation route when it is proximate to the user interface 100, by means of a short-range wireless beacon, such as a Bluetooth beacon, transmitted from a Bluetooth beacon transmitter 109 in the user interface 100, to a Bluetooth receiver 172 in the occupant's mobile wireless device 170. When the occupant's mobile wireless device 170 is proximate to the user interface 100 in a particular zone, the user interface 100 senses the presence of the occupant's device 170 over the Bluetooth link and, in response, signals the building automation emergency response and occupant evacuation system 160 to transmit to the occupant's mobile wireless device 170 the same depiction of the evacuation route that is being sent to the user interface 100 in that particular zone.

Figure 2A:
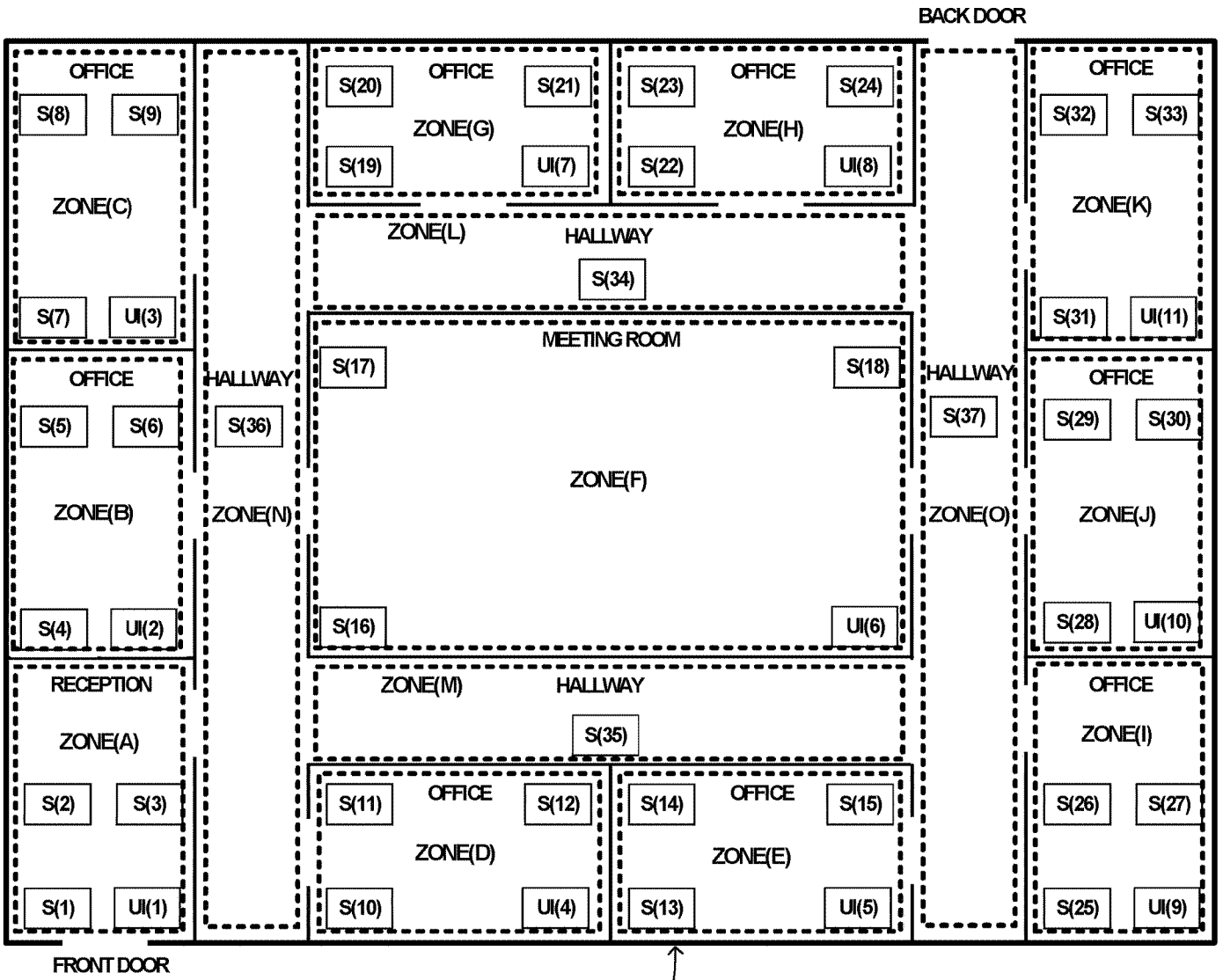
FIG. 2A is an example plan view of the floor plan of the building of FIG. 2, showing zones in the building and the sensors and user interfaces distributed among the zones, according to an embodiment of the disclosure.

FIG. 2A is an example plan view of the floor plan of the building of FIG. 2, showing zones in the building and the sensors and user interfaces distributed among the zones, according to an embodiment of the disclosure. The zones labeled Zone(A) through Zone(N) may be defined on the floor plan of FIG. 2 at the time of commissioning the building automation emergency response and occupant evacuation system 160 integrated into the building automation system 150 for the building. Each of the zones may include one or more sensors 124 and one or more user interfaces 100. The positioning of the zones, sensors 124 and user interfaces 100 in the building may be recorded in the building automation emergency response and occupant evacuation system 160 at the time of commissioning.

Past-Present Zone Danger Level

The building automation emergency response and occupant evacuation system 160 maintains a record of past received indications comprising past instances of sensor reading levels of the detected emergency and the identity of the sensors 124 producing the reading level in a zone. The zone that includes a particular sensor 124 is determined from a look-up table of unique identities for the respective sensors 124 and the identity of a zone where a respective sensor is located. The building automation emergency response and occupant evacuation system 160 determines a past-present zone danger level of the detected emergency in a zone, based on calculating a sum of products of weight values for the past instances of the sensor reading levels times the past sensor reading levels. The weight values for the past instances of sensor reading level may be based on how frequently and recently the past instances of sensor reading level have been detected by the sensors. The past-present zone danger level of a zone is calculated by adding the present sensor reading level and the past sensor reading levels of the zone. The following Table A shows an example of a record of past instances of the sensor reading level SA[t] at time "t" for sensors s(1) and S(2) in Zone(A). The time t starts at t=0 and continues as t=1, then t=2, etc. The table also shows an example calculation of the sensor danger values for S(1) and S(2) as sums of products of the sensor reading times an example weight value "W". The table also shows an example calculation of the danger value for Zone(A) as a sum of the danger values for the fire sensor S(1) and the smoke sensor S(2) in Zone(A):

TABLE A

| | | | | | |
|---|---|---|---|---|---|
| Sensor Danger | (SA[t])*W+ | (SA[t − 1])*W+ | (SA[t − 2])*W+ | (SA[t − 3])*W+ | Sum = Danger |
| Sensor Danger | (SA[t])/1+ | (SA[t − 1])/2+ | (SA[t − 2])/3+ | (SA[t − 3])/4+ | Sum = Danger |
| S(1) | 100/1 | 100/2 | 0/3 | 0/4 | S(1) Danger |
| Fire Sensor | | | | | Sum = 150 |
| S(2) | 100/1 | 0/2 | 0/3 | 0/4 | S(2) Danger |
| Smoke Sensor | | | | | Sum = 100 |
| Zone(A) | | | | | Zone(A) Danger |
| Zone Danger | | | | | Sum of Sensors = |
| | | | | | 150 + 100 = 250 |

To more clearly show weighting of sensor types in Table A, weights (W) may be applied to the total for each sensor. This is a way of expressing that type of danger is worse than another. For example, if fire is considered to be twice as dangerous as smoke, then S(1) could have a weight of Ws=0.5 for smoke and S(0) would have a weight of Wf=1 for fire. In Table A, this would give:

$$\text{Zone}(A)\text{Danger Sum of Sensors}=(150*Wf)+(100*Ws)=\text{Danger(at time } t=1)$$

$$\text{Zone}(A)\text{Danger Sum of Sensors}=(150*1)+(100*0.5)=200\text{(at time } t=1)$$

A record is kept of each zone in which an emergency sensor has been triggered. Danger in a zone may be determined by number of sensor activations weighted by how long ago they occurred. Given the type of sensor, a scale factor or weight may be applied to the sensor danger value, for example gunshots are more dangerous than a fire emergency. The sensor readings for fire emergencies or gas leak emergencies may provide an analog sensor reading based on the severity of the emergency. The sensor readings for gunshot emergencies may provide an analog sensor reading based on a decibel level indicating a caliber of the gun. The example weight value may be a function that may be tuned by a systems installer or by data accumulation over time.

Figure 2B:
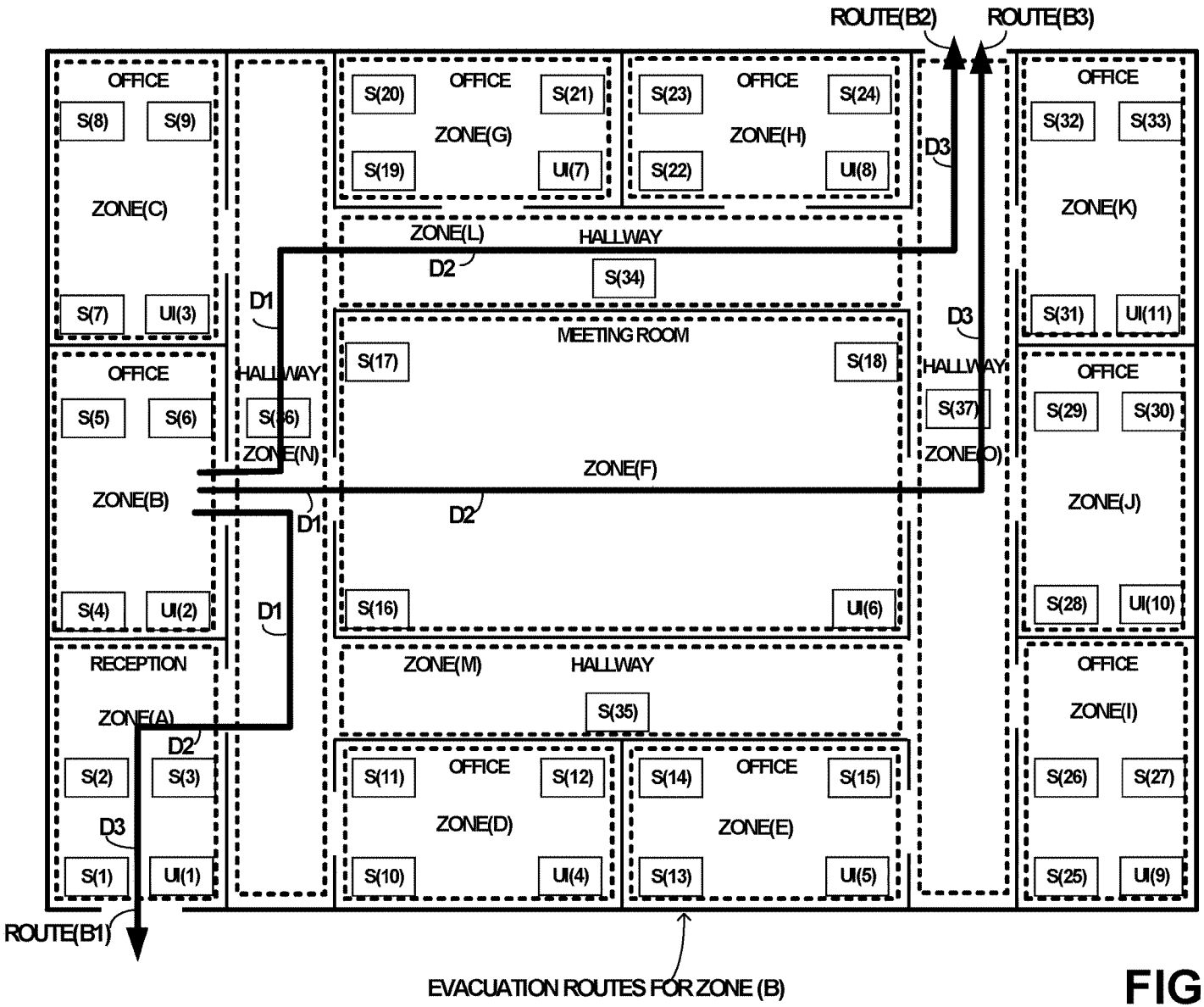
FIG. 2B is an example plan view of the floor plan of the building of FIG. 2A, showing three possible evacuation routes for Zone(B), according to an embodiment of the disclosure.
Figure 2C:
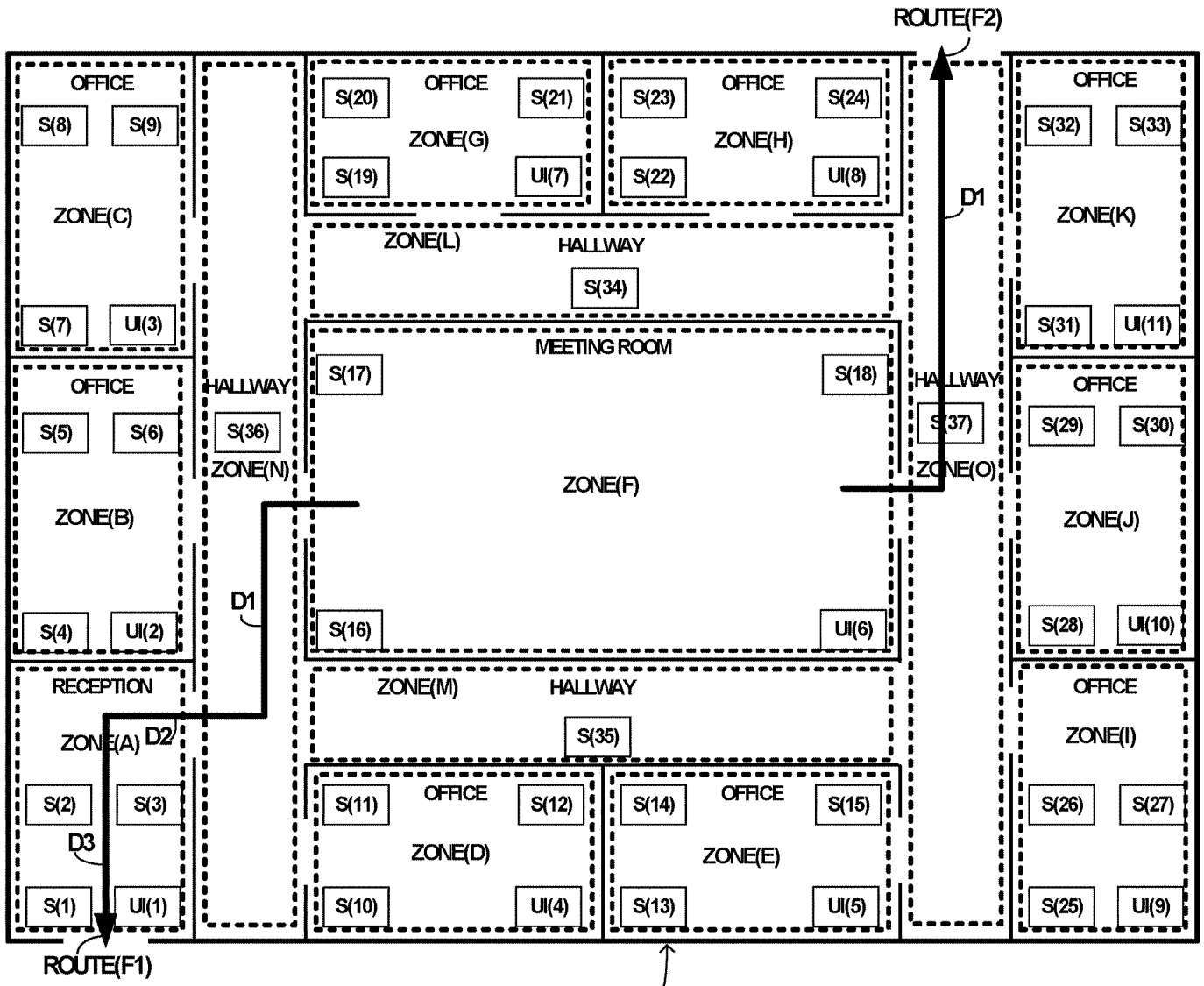
FIG. 2C is an example plan view of the floor plan of the building of FIG. 2A, showing three possible evacuation routes for Zone(J), according to an embodiment of the disclosure.

FIG. 2B is an example plan view of the floor plan of the building of FIG. 2A, showing three possible evacuation routes labeled ROUTE(B1), ROUTE(B2), and ROUTE(B3) for Zone(B), according to an embodiment of the disclosure. Similarly, FIG. 2C is an example plan view of the floor plan of the building of FIG. 2A, showing two possible evacuation routes labeled ROUTE(F1) and ROUTE(F2) for Zone(F), according to an embodiment of the disclosure. The possible evacuation routes may be defined on the floor plan of FIG. 2 at the time of commissioning the building automation emergency response and occupant evacuation system 160 integrated into the building automation system 150 for the building. As part of the definition of each route, the length of the component segments, such as D1, D2, and D3 for Route(B3) from Zone(B) in FIG. 2B, is recorded and will be used during an emergency to determine the safest evacuation route. The following Table B shows an example of a record of the possible evacuation routes labeled ROUTE(B1), ROUTE(B2), and ROUTE(B3) for Zone(B) in FIG. 2B. The length of the component segments, such as D1, D2, and D3, is shown in meters.

TABLE B

| | | | |
|---|---|---|---|
| ROUTE(B1) | D1 = 3 meters in Zone(N) | D2 = 1 meter in Zone(A) | D3 = 2.5 meters in Zone(A) |
| ROUTE(B2) | D1 = 3 meters in Zone(N) | D2 = 9 meters in Zone(L) | D3 = 3 meters in Zone(O) |
| ROUTE(B3) | D1 = 1.5 meters in Zone(N) | D2 = 9 meters in Zone(F) | D3 = 6 meters in Zone(O) |

During a detected emergency, as discussed above, the past-present zone danger level of a zone for the zones in the building is calculated by adding the present sensor reading level and the past sensor reading levels of the zone. In this example, fire has been detected by the sensor S(1) in Zone(A) and smoke has been detected by sensor S(36) in Zone(N). The building automation emergency response and occupant evacuation system 160 calculates a respective evacuation route commencing from the user interfaces 100 distributed among the zones in the building. The evacuation route is calculated to traverse one or more zones having respective zone danger levels. A route danger level is computed as a sum of products of distance segments along the route and the respective zone danger level of the zones traversed by the segments. The safest evacuation route is the route that has a minimum route danger level in reaching a respective safe exit location of the building. Each proposed evacuation route commencing from a given zone is examined by calculating a route danger level as the sum of the products of the length of the component segments, such as D1, D2, and D3 for Route(B3) from Zone(B), times the zone danger level for each respective zone through which the segment passes in FIG. 2B. The following Table C shows an example calculation of the route danger level during the example emergency to determine the safest evacuation route commencing from Zone(B), from among the three possible evacuation routes: ROUTE(B1), ROUTE(B2), and ROUTE (B3) in FIG. 2B.

TABLE C

| | | | | |
|---|---|---|---|---|
| ROUTE (B1) | D1 = 3 * 100 in Zone(N) (smoke) | D2 = 1 * 300 in Zone(A) (fire) | D3 = 2.5 * 300 in Zone(A) (fire) | Route Danger Level = 1350 for Route (B1) |
| ROUTE (B2) | D1 = 3 * 100 in Zone(N) (smoke) | D2 = 9 *0 in Zone(L) | D3 = 3 * 0 in Zone(O) | Route Danger Level = 300 for Route (B2) |

TABLE C-continued

| | | | | |
|---|---|---|---|---|
| ROUTE (B3) | D1 = 1.5 * 100 in Zone(N) (smoke) | D2 = 9 * 0 in Zone(F) | D3 = 6 * 0 in Zone(O) | Route Danger Level = 150 for Route (B3) |

The Route(B3) has the smallest route danger level for the sum of the products of the length of the component segments, D1, D2, and D3 for Route(B3) from Zone(B), times the zone danger level for each respective zone Zone(N), Zone(F), and Zone(O) through which the respective segments pass in FIG. 2B. Thus, ROUTE(B3) is the safest evacuation route commencing from Zone(B), to avoid the fire emergency detected in Zone (A) and smoke emergency in Zone(N), according to an embodiment of the disclosure. FIG. 3A is an example display on the user interface UI(2) in Zone(B) showing of the floor plan of the building of FIG. 2A, and showing the safest evacuation route ROUTE(B3) from Zone(B), to avoid the emergency detected in Zone (A) and Zone(N). FIG. 3C is an example flow diagram of an example method for computing past-present zone danger level of a zone, according to an embodiment of the disclosure.

Continuing with the example, fire has been detected by the sensor S(1) in Zone(A) and smoke has been detected by sensor S(36) in Zone(N). For an evacuation commencing from Zone(F), each proposed evacuation route is examined by calculating the route danger level as a sum of the products of the length of the component segments, such as D1, D2, and D3 for Route(F1) from Zone(F), times the zone danger level for each respective zone through which the segment passes. The following Table D shows an example calculation of the route danger level during the example emergency to determine the safest evacuation route commencing from Zone(F), from among the two possible evacuation routes: ROUTE(F1) and ROUTE(F2).

TABLE D

| | | | | |
|---|---|---|---|---|
| ROUTE(F1) | D1 = 3 * 100 in Zone(N) (smoke) | D2 = 1 * 300 in Zone(A) (fire) | D3 = 2.5 * 300 in Zone(A) | Route Danger Level = 1350 for Route (F1) |
| ROUTE(F2) | D1 = 3 * 0 in Zone(O) | | | Route Danger Level = 0 for Route (B2) |

The Route(F2) has the smallest route danger level for the sum of the products of the length of the component segment D1 for Route(F2) from Zone(F), times the zone danger level for Zone(O) through which the respective segment passes. Thus, ROUTE(F2) is the safest evacuation route commencing from Zone(F), to avoid the fire emergency detected in Zone (A) and smoke emergency in Zone(N), according to an embodiment of the disclosure. FIG. 3B is an example display on the user interface UI(6) in Zone(F) showing of the floor plan of the building of FIG. 2A, and showing the safest evacuation route ROUTE(F2) commencing from Zone(F), to avoid the emergency detected in Zone (A) and Zone(N).

Continuing with the example, fire has been detected by the sensor S(1) in Zone(A) and smoke has been detected by sensor S(36) in Zone(N). An occupant in the office in Zone(B) may begin an evacuation by viewing the user interface UI(2) in Zone(B) showing the safest evacuation route ROUTE(B3) commencing from Zone(B), to avoid the emergency detected in Zone (A) and Zone(N). The occupant follows ROUTE(B3), which leads into Zone(F). The occupant may continue the evacuation by viewing the user interface UI(6) in Zone(F) showing the safest evacuation route ROUTE(F2) commencing from Zone(F), to the exit at the back door of the building. The building automation emergency response and occupant evacuation system 160 provides to each user interface 100 in each respective zone of the building, a respective depiction of the evacuation route commencing from the respective zone, which provides an occupant viewing each respective user interface along the evacuation route, with a situational awareness that is unique to that respective zone.

Different safest routes are transmitted to the different user interfaces, since the user interfaces each have their own safest route based on their location relative to the exits and the emergency. The server transmits one or more depictions of the safest evacuation routes to the one or more user interfaces in the one or more zones for display on one or more display devices. The one or more depictions are of the one or more safest routes transmitted to respective ones of the one or more user interfaces, based on the locations of the respective ones of the one or more user interfaces relative to the one or more exit locations and the detected emergency.

The building automation emergency response and occupant evacuation system 160 may receive updated indications of the detected emergency in the building from the one or more sensors 124. In response, the building automation emergency response and occupant evacuation system 160 determines updated zone danger levels in the one or more zones, calculates updated route danger levels based on the updated zone danger levels, determines updated safest evacuation routes based on the updated route danger levels, and transmits the updated depictions of the safest evacuation routes to the one or more user interfaces 100 for display.

FIG. 3C is an example flow diagram of an example method for computing past-present zone danger level of a zone, according to an embodiment of the disclosure. When danger is detected in any zone "X", for each zone in the building, each sensor "Y" is read. The building automation emergency response and occupant evacuation system 160 determines a past-present zone danger level of the detected emergency in a zone "X", based on calculating a sum of products of weight values for the past instances of the sensor reading levels times the past sensor reading levels. The weight values for the past instances of sensor reading level may be based on how frequently and recently the past instances of sensor reading level have been detected by the sensors. The past-present zone danger level of a zone is calculated by adding the present sensor reading level and the past sensor reading levels of the zone.

The building automation emergency response and occupant evacuation system 160 calculates a respective evacuation route "Z" commencing from the user interfaces 100 distributed among the zones in the building. The evacuation route is calculated to traverse one or more zones having respective zone danger levels. A route danger level is computed as a sum of products of distance segments along the route and the respective zone danger level of the zones traversed by the segments. The safest evacuation route is the route that has a minimum route danger level in reaching a respective safe exit location of the building.

Present-Predicted Zone Danger Level

The building automation emergency response and occupant evacuation system 160 may determine a predicted sensor danger level of the detected emergency in the one or more sensors, based on a predicted rate of movement of the emergency or on structural or other conditions of the zones. For example, emergencies such as fire, smoke, hazardous materials release, natural gas leaks, and flooding naturally expand, sometimes quickly, from a zone of initial occurrence to adjacent zones. For example, in FIG. 2B, an initial fire emergency detected by the fire sensor S(1) in Zone(A) has produced an initial smoke emergency detected by the smoke sensor S(36) in the adjacent Zone(N). It is predictable that, in a short time, the heat and flames from the fire emergency in Zone(1) will spread to the adjacent Zone(N) and become a more dangerous fire emergency in Zone(N). The building automation emergency response and occupant evacuation system 160 determines a predicted zone danger level in the adjacent Zone(N), based the detected emergency in the zone of initial occurrence, Zone(A). The likelihood of the spreading of a particular type of emergency, such as fire, smoke, hazardous materials release, natural gas leaks, or flooding, may be characterized by a predicted zone danger level that may be stored in the system's memory 132 at the time of commissioning the building automation emergency response and occupant evacuation system 160 or that may be tuned by a systems installer or by data accumulation over time. The predicted zone danger level for a fire emergency, for example, may be based on the relative flammability of structural materials in an adjacent zone or the proximity of ventilation fans to an adjacent zone. The building automation emergency response and occupant evacuation system 160 calculates a present-predicted zone danger level of an adjacent zone, such as Zone(N), by adding the present zone danger level of the adjacent zone and the predicted zone danger level of the adjacent zone.

Continue with the example of the fire detected by the sensor S(1) in Zone(A) and smoke detected by sensor S(36) in Zone(N). For an evacuation commencing from Zone(B), each proposed evacuation route commencing from Zone(B) is examined by calculating a route danger level as the sum of the products of the length of the component segments, such as D1, D2, and D3 for Route(B3) from Zone(B), times the zone danger level for each respective zone through which the segment passes in FIG. 2B.

FIG. 4 is an example plan view of the floor plan of the building of FIG. 2, showing a fire prediction map for fire in Zone(A) with 3-minute time increments for the fire to spread to the other zones, according to an embodiment of the disclosure. At the time of commissioning the building automation emergency response and occupant evacuation system 160, the fire prediction map of FIG. 4 is compiled and stored in memory 132, of the predicted sensor danger level in each of the zones (A) through (N) for a fire starting in Zone(A). The fire prediction map is based on structural or other conditions of each of the zones (A) through (N) where each sensor is located. A total of 14 different fire prediction maps are compiled and stored, one for each of the zones (A) through (N) where a different fire is simulated to originate. Each zone on the fire prediction map of FIG. 4 has an encircled label indicating the number of minutes it is predicted for a spreading fire to reach the zone since the instant of the origin of the fire in Zone(A).

At the time of 3 minutes after the fire starts in Zone(A), the fire is predicted to spread to the adjacent Zone(N). The building automation emergency response and occupant evacuation system 160 calculates a present-predicted zone danger level of Zone(N), by adding the present zone danger level of Zone(N) (smoke=100) and the predicted zone danger level of Zone(N) at 3 minutes into the future (fire=100). In this example, the predicted zone danger level of Zone(N) at 3 minutes into the future is 100, because it is adjacent to Zone(A) where there is presently a fire emergency. The following Table E shows an example calculation of the route danger level during the example emergency at 3 minutes into the future, to determine the safest evacuation route commencing from Zone(B), from among the three possible evacuation routes: ROUTE(B1), ROUTE(B2), and ROUTE(B3) in FIG. 2B.

TABLE E

| At 30 Minutes into the Future | | | | |
|---|---|---|---|---|
| ROUTE (B1) | D1 = 3*(100 + 100) in Zone(N) (smoke + fire @ 3 min) | D2 = 1 * 300 in Zone(A) (fire) | D3 = 2.5 * 300 in Zone(A) (fire) | Route Danger Level = 1650 for Route (B1) |
| ROUTE (B2) | D1 = 3*(100 + 100) in Zone(N) (smoke + fire @ 3 min) | D2 = 9 *0 in Zone(L) | D3 = 3 * 0 in Zone(O) | Route Danger Level = 600 for Route (B2) |
| ROUTE (B3) | D1 = 1.5 *(100 + 100) in Zone(N) (smoke + fire @ 3 min) | D2 = 9 * 0 in Zone(F) | D3 = 6 * 0 in Zone(O) | Route Danger Level = 300 for Route (B3) |

For the adjacent Zone(N), the building automation emergency response and occupant evacuation system 160 calculates a present-predicted zone danger level of Zone(N), by adding the present zone danger level of Zone(N) (smoke=100) and the predicted zone danger level of Zone (N) (fire at 3 minutes=100). In this example, the predicted zone danger level of Zone(N) at 3 minutes is 100. The Route(B3) has the smallest route danger level for the sum of the products of the length of the component segments, D1, D2, and D3 for Route(B3) from Zone(B), times the zone danger level at 3 minutes for each respective zone Zone(N), Zone(F), and Zone(O) through which the respective segments pass in FIG. 2B. Thus, ROUTE(B3) is the safest evacuation route commencing from Zone(B), to avoid the fire emergency detected in Zone (A) and the potential of fire emergency, as well as smoke emergency, in Zone(N), according to an embodiment of the disclosure. FIG. 4A is an example display on the user interface UI(2) in Zone(B) showing the display by user interface UI(2) of the safest evacuation ROUTE(B3) from Zone(B) at 3 minutes into the future, according to an embodiment of the disclosure. In this situation, the user may take ROUTE(B3) through Zone(N) with a higher danger score of 600, because the route only passes through a short distance D1 through Zone(N) and therefore gives an overall lower danger score for the route. Note that at the time of 3 minutes, a fire begins in the Zone(B), indicating the increasing urgency of evacuation.

At the time of 6 minutes after the fire starts in Zone(A), the fire prediction map indicates the fire is predicted to have spread to zones (B), (C), (D), (F), (M), and (N). The building automation emergency response and occupant evacuation system 160 calculates a present-predicted zone danger level of Zone(F), by adding the present zone danger level of Zone(F) (=0) and the predicted zone danger level of Zone(F) (fire=100) at 6 minutes into the future. In this example, the predicted zone danger level of Zone(F) is 100 at 6 minutes after the fire starts in Zone(A), which raises the route danger level for ROUTE(B3) 1200. The ROUTE(B3) is no longer the safest evacuation route, because fire is predicted to have spread to Zone(F) by 6 minutes. The ROUTE(B2) will be the safest evacuation route, by 6 minutes after the fire starts in Zone(A). The following Table F shows an example calculation of the route danger level during the example emergency at 6 minutes into the future, to determine the safest evacuation route commencing from Zone(B), from among the three possible evacuation routes: ROUTE(B1), ROUTE (B2), and ROUTE(B3) in FIG. 2B.

TABLE F

| At 60 Minutes into the Future | | | | |
|---|---|---|---|---|
| ROUTE (B1) | D1 = 3*(100 + 100) in Zone(N) (smoke + fire @ 6 min) | D2 = 1 * 300 in Zone(A) (fire) | D3 = 2.5 * 300 in Zone(A) (fire) | Route Danger Level = 1650 for Route (B1) |
| ROUTE (B2) | D1 = 3*(100 + 100) in Zone(N) (smoke + fire @ 6 min) | D2 = 9 *0 in Zone(L) | D3 = 3 * 0 in Zone(O) | Route Danger Level = 600 for Route (B2) |
| ROUTE (B3) | D1 = 1.5 *(100 + 100) in Zone(N) (smoke + fire @ 6 min) | D2 = 9 * 100 in Zone(F) (fire @ 6 min) | D3 = 6 * 0 in Zone(O) | Route Danger Level = 1200 for Route (B3) |

For the Zone(F), the building automation emergency response and occupant evacuation system 160 calculates a present-predicted zone danger level of Zone(F), by adding the present zone danger level of Zone(F) (=0) and the predicted zone danger level of Zone(F) (fire at 6 minutes=100). The Route(B2) has the smallest route danger level for the sum of the products of the length of the component segments, D1, D2, and D3 for Route(B2) from Zone(B), times the zone danger level at 6 minutes for each respective zone Zone(N), Zone(L), and Zone(O) through which the respective segments pass in FIG. 2B. Thus, ROUTE(B2) is the safest evacuation route commencing from Zone(B) at 6 minutes into the future, to avoid the fire emergency detected in Zone (A) and the fire emergency in Zone(F), according to an embodiment of the disclosure. FIG. 4B is an example display on the user interface UI(2) in Zone(B) showing the display by user interface UI(2) of the safest evacuation ROUTE(B2) from Zone(B) at 6 minutes into the future, according to an embodiment of the disclosure. In this situation, the user may take ROUTE(B2) through Zone(N) with a higher danger score of 600, because the route only passes through a short distance D1 through Zone(N) and therefore gives an overall lower danger score for the route. Note that at the time of 6 minutes, a fire is in the Zone(B), indicating the urgency of evacuation.

In an embodiment, the building automation emergency response and occupant evacuation system 160 may determine the safest route by calculating the route dangers over time (for example in increments of 1 minute) and add them all together to get a total for each route. The danger of a zone may change as the occupant is passing through the zone. The change in danger may be determined by observing the occupant's movement speed and simulating the occupant's motion through the path/zones over time and calculating the danger at each point in time along a path through the zones.

A predicted sensor danger level of the detected emergency for a sensor may be based on structural or other conditions of the zone where the sensor is located. For example, the building may have been constructed in stages, with the back section of the building having been constructed of wood and wall board materials, which are more combustible than brick and block construction in other parts of the building. At the time of commissioning the building automation emergency response and occupant evacuation system 160, a table is compiled and stored in memory 132 of the predicted sensor danger level in the zones, based on structural or other conditions of the zone where each sensor is located. The following example Table G stored in memory 132, correlates the predicted sensor danger level in the zones Zone(G), Zone(H), and Zone(L) that are constructed of combustible wood and wall board materials. Other zones Zone(D), and Zone(E) are also shown in Table G, which are located in portions of the building that are not constructed of combustible materials, and thus have a low value for the predicted sensor danger level. The following Table G is used when the detected emergency is a fire emergency.

TABLE G

Zone Combustibility Conditions

| Zone | Predicted Sensor Danger Levels for Fire Emergencies | Zone Condition |
|---|---|---|
| Zone(D) | None | Not Combustible |
| Zone(E) | None | Not Combustible |
| . . . | | |
| Zone(G) | 100 | Combustible |
| Zone(H) | 100 | Combustible |
| . . . | | |
| Zone(L) | 100 | Combustible |

Continue with the example of the fire detected by the sensor S(1) in Zone(A) and smoke detected by sensor S(36) in Zone(N). For an evacuation commencing from Zone(B), each proposed evacuation route commencing from Zone(B) is examined by calculating a route danger level as the sum of the products of the length of the component segments, such as D1, D2, and D3 for Route(B2) from Zone(B), times the zone danger level for each respective zone through which the segment passes in FIG. 2B. For the Zone(L) through which ROUTE(B2) passes, the building automation emergency response and occupant evacuation system 160 calculates a present-predicted zone danger level of Zone(L), by adding the present zone danger level of Zone(L) and the predicted zone danger level of Zone(L). In this example, the predicted zone danger level of Zone(L) is 100 because it is listed in Table Gas constructed of combustible materials. The following Table H shows an example calculation of the route danger level during the example emergency to determine the safest evacuation route commencing from Zone (B), from among the three possible evacuation routes: ROUTE(B1), ROUTE(B2), and ROUTE(B3) in FIG. 2B.

TABLE H

Effect of Combustible Zones

| | | | | |
|---|---|---|---|---|
| ROUTE (B1) | D1 = 3*(100 + 100) in Zone(N) | D2 = 1 * 300 in Zone(A) | D3 = 2.5 * 300 in Zone (A) | Route Danger Level = 1650 for Route (B1) |
| ROUTE (B2) | D1 = 3*(100 + 100) in Zone(N) | D2 = 9 *100 in Zone(L) (combustible) | D3 = 3 * 0 in Zone(O) | Route Danger Level = 1500 for Route (B2) |
| ROUTE (B3) | D1 = 1.5 *(100 + 100) in Zone(N) | D2 = 9 * 0 in Zone(F) | D3 = 6 * 0 in Zone(O) | Route Danger Level = 300 for Route (B3) |

For the Zone(L), the building automation emergency response and occupant evacuation system 160 calculates a present-predicted zone danger level of Zone(L), by adding the present zone danger level of Zone(L) and the predicted zone danger level of Zone(L) in Table G due to combustibility of the zone. The Route(B2) route danger level is calculated as the sum of the products of the length of the component segments, D1, D2, and D3 for Route(B2) from Zone(B), times the zone danger level for each respective zone Zone(N), Zone(L), and Zone(O) through which the respective segments pass in FIG. 2B. In this example, the predicted zone danger level of Zone(L) is 100 in Table G, which raises the route danger level of ROUTE(B2) to 1500 in Table H. The example predicted zone danger levels for zones in Table G may be a function that may be tuned by a systems installer or by data accumulation over time.

The Route(B3) has the smallest route danger level in Table H for the sum of the products of the length of the component segments, D1, D2, and D3 for Route(B3) from Zone(B), times the zone danger level for each respective zone Zone(N), Zone(F), and Zone(O) through which the respective segments pass in FIG. 2B. Thus, ROUTE(B3) is the safest evacuation route commencing from Zone(B), to avoid the fire emergency detected in Zone (A) and the potential of fire emergency, as well as smoke emergency, in Zone(N), according to an embodiment of the disclosure. FIG. 3A is an example display on the user interface UI(2) in Zone(B) showing of the floor plan of the building of FIG. 2A, and showing the safest evacuation route ROUTE(B3) from Zone(B), to avoid the emergency detected in Zone (A) and Zone(N).

For certain types of threats, there are logical paths the threat is likely to proceed on. For non human threats such as fire and gas leaks, it may be assumed that they will spread into surrounding zones, factoring in the material of the zones and any barriers. A speed factor may be applied during commissioning to change the rate of spread based on the building materials and ventilation connections. Danger may be calculated into the future for T seconds (t=0 t=T). At each point in time (t), the system may determine the location of the danger along a vector of movement and if the danger is expected to enter a zone, the zone danger level may be increased.

Past-Present-Predicted Zone Danger Level

In example embodiments, the building automation emergency response and occupant evacuation system 160 determines a predicted sensor danger level of the detected emergency in the one or more sensors, based on a predicted rate of movement of the emergency or on structural or other conditions of the zones, as previously discussed. The building automation emergency response and occupant evacuation system 160 determines a predicted zone danger level of the detected emergency in the one or more zones, based on the predicted sensor danger level of the detected emergency of the one or more sensors in the one or more zones, as previously discussed. In this embodiment, the building automation emergency response and occupant evacuation system 160 calculates a past-present-predicted zone danger level of the one or more zones by adding the past-present zone danger level and the predicted zone danger level of the one or more zones. The building automation emergency response and occupant evacuation system 160 then calculates the safest evacuation route as the minimum value route danger level for the one or more evacuation routes based on the past-present-predicted zone danger level of the one or more zones.

In example embodiments, the building automation emergency response and occupant evacuation system 160 calculates the safest evacuation route, based at least on one of [1] avoiding where the emergency has been located and is currently located, or [2] avoiding where the emergency is predicted to be located.

FIG. 4C is an example flow diagram of an example method for computing present-predicted (future) zone danger level of a zone, according to an embodiment of the disclosure. When danger is detected in any zone, for each zone "X" in the building, each sensor "Y" is read. During the emergency, prior movement of the threat "Q" may be used to predict future movement of the location of that threat entering zone "X" at a time "T". Add the danger to future predictions of the zone "X" at time "T" for the threat "Q". The zone "X" danger level is calculated by adding the present sensor reading level and the future predictions of the zone "X" at time "T" for the threat "Q".

The building automation emergency response and occupant evacuation system 160 calculates a respective evacuation route "Z" commencing from the user interfaces 100 distributed among the zones in the building. The evacuation route is calculated to traverse one or more zones having respective zone danger levels. A route danger level is computed as a sum of products of distance segments along the route and the respective zone danger level of the zones traversed by the segments. The safest evacuation route is the route that has a minimum route danger level in reaching a respective safe exit location of the building.

FIG. 4D is an example flow diagram of an example method for computing past-present-predicted (future) zone danger level of a zone, according to an embodiment of the disclosure. When danger is detected in any zone "X", for each zone in the building, each sensor "Y" is read. The building automation emergency response and occupant evacuation system 160 determines a past-present zone danger level of the detected emergency in a zone "X", based on calculating a sum of products of weight values for the past instances of the sensor reading levels times the past sensor reading levels. The weight values for the past instances of sensor reading level may be based on how frequently and recently the past instances of sensor reading level have been detected by the sensors. The past-present zone danger level of a zone is calculated by adding the present sensor reading level and the past sensor reading levels of the zone. During the emergency, prior movement of the threat "Q" may be used to predict future movement of the location of that threat entering zone "X" at a time "T". Add the danger to future predictions of the zone "X" at time "T" for the threat "Q". The zone "X" danger level is calculated by adding the past-present zone danger level and the future predictions of the zone "X" at time "T" for the threat "Q".

The building automation emergency response and occupant evacuation system 160 calculates a respective evacuation route "Z" commencing from the user interfaces 100 distributed among the zones in the building. The evacuation route is calculated to traverse one or more zones having respective zone danger levels. A route danger level is computed as a sum of products of distance segments along the route and the respective zone danger level of the zones traversed by the segments. The safest evacuation route is the route that has a minimum route danger level in reaching a respective safe exit location of the building.

Predicted Zone Danger Level from Human Threats

For human threats, it may be more likely that they will proceed in a given direction in search of some target or goal and will move along human traversable paths provided in the building's floor plan during commissioning. The likelihood of the human threat traversing a possible path may be determined by each possible path's similarity in its direction to a predicted direction of travel by the human threat. During the emergency, prior movement of the human threat may be used to predict future movement of the location of that threat. In predicting where a human threat may be located in the future, the system may simulate future situations and display evacuation routes according to present and predicted threats. For simulation of a predicted danger, an algorithm for calculating the safest evacuation route may consider time (t) at each step of the calculation. An assumption may be made as to the movement speed of the occupants during an evacuation. The time needed by an occupant to reach a given zone along the evacuation route may be used as a weight value to be multiplied times a given zone danger level. A safest evacuation route will be based on a minimum route danger level among the possible evacuation routes.

FIG. 5 is an example plan view of the floor plan of the building of FIG. 2, showing an active shooter prediction map for a gunman entering the reception area in Zone(A) with 3-minute time increments for the gunman to move to the other zones, according to an embodiment of the disclosure. At the time of commissioning the building automation emergency response and occupant evacuation system 160, the active shooter prediction map of FIG. 5 is compiled and stored in memory 132, of the predicted gunshot sensor danger level in each of the zones (A) through (N) for a gunman starting in Zone(A). The active shooter prediction map is based on national experiences over several years of active shooter situations. Estimates are made of the rate of movement of a hypothetical active shooter through each of the zones (A) through (N) where each gunshot sensor is located. In this example, since there are only two entrances to the building where an active shooter could enter, through the front and back doors, a total of two different active shooter prediction maps may be compiled and stored, one for Zone(A) at the front door and one for Zone(O) at the back door. Each zone on the active shooter prediction map of FIG. 5 has an encircled label indicating the number of minutes it is predicted for a gunman to reach the zone since the instant of the first gunshot detected from the gunman in Zone(A).

FIG. 5A is an example display on the user interface UI(2) in Zone(B) showing the display by user interface UI(2) of the active shooter prediction map. Among the three routes ROUTE(B1), ROUTE(B2), and ROUTE(B3) shown in FIG. 2B, the safest evacuation route is ROUTE(B2) from Zone (B) at 6 minutes into the future, according to an embodiment of the disclosure. At the time of 6 minutes after the gunman starts in Zone(A), the active shooter prediction map of FIG. 5 indicates that the gunman is predicted to have moved to zones (B), (C), (D), (F), (M), and (N). The building automation emergency response and occupant evacuation system 160 calculates a present-predicted zone danger level of Zone(F), by adding the present zone danger level of Zone(F) (=0) and the predicted zone danger level of Zone(F) (gunman=100) at 6 minutes into the future. In this example, the predicted zone danger level of Zone(F) is 100 at 6 minutes after the gunman starts in Zone(A), which raises the route danger level for ROUTE(B3) 1050. The ROUTE(B3) is no longer the safest evacuation route, because gunman is predicted to have moved to Zone(F) by 6 minutes. The ROUTE (B2) will be the safest evacuation route, by 6 minutes after the gunman starts in Zone(A). The following Table I shows an example calculation of the route danger level during the example emergency at 6 minutes into the future, to determine the safest evacuation route commencing from Zone (B), from among the three possible evacuation routes: ROUTE(B1), ROUTE(B2), and ROUTE(B3) in FIG. 2B.

TABLE I

| At 6 Minutes into the Future | | | | |
|---|---|---|---|---|
| ROUTE (B1) | D1 = 3*(100) in Zone(N) (gunman @ 60 sec) | D2 = 1 * 300 in Zone(A) (gunman) | D3 = 2.5 * 300 in Zone(A) (gunman) | Route Danger Level = 1350 for Route (B1) |

TABLE I-continued

| At 6 Minutes into the Future | | | | |
|---|---|---|---|---|
| ROUTE (B2) | D1 = 3*(100) in Zone(N) (gunman @ 60 sec) | D2 = 9 *0 in Zone(L) | D3 = 3 * 0 in Zone(O) | Route Danger Level = 300 for Route (B2) |
| ROUTE (B3) | D1 = 1.5 *(100) in Zone(N) (gunman @ 60 sec) | D2 = 9 * 100 in Zone(F) (gunman @ 60 sec) | D3 = 6 * 0 in Zone(O) | Route Danger Level = 1050 for Route (B3) |

For Zone(F), the building automation emergency response and occupant evacuation system 160 calculates a present-predicted zone danger level of Zone(F), by adding the present zone danger level of Zone(F) (=0) and the predicted zone danger level of Zone(F) (gunman at 6 minutes=100). The Route(B2) has the smallest route danger level for the sum of the products of the length of the component segments, D1, D2, and D3 for Route(B2) from Zone(B), times the zone danger level at 6 minutes for each respective zone Zone(N), Zone(L), and Zone(O) through which the respective segments pass in FIG. 2B. Thus, ROUTE(B2) is the safest evacuation route commencing from Zone(B) at 6 minutes into the future, to avoid the gunman emergency detected in Zone (A) and the gunman emergency in Zone(F), according to an embodiment of the disclosure. FIG. 5A is an example display on the user interface UI(2) in Zone(B) showing the display by user interface UI(2) of the safest evacuation ROUTE(B2) from Zone(B) at 6 minutes into the future, according to an embodiment of the disclosure. In this situation, the user may take ROUTE(B2) through Zone(N) with a higher danger score of 300, because the route only passes through a short distance D1 through Zone(N) and therefore gives an overall lower danger score for the route. Note that at the time of 6 minutes, a gunman is in the Zone(B), indicating the urgency of evacuation.

FIG. 6 is an example flow diagram of a method performed by the example building automation emergency response and occupant evacuation system 160 of FIG. 1, according to an embodiment of the disclosure. The logic blocks 500 of the flow diagram may be implemented by computer program instructions stored in the memory 132 and executed by the processor in the emergency server 130 of FIG. 1. Alternately, the logic blocks 500 of the flow diagram may also be implemented by computer hardware logic in the emergency server 130 of FIG. 1, which can carry out the functions specified by the logic blocks.

The method performed by the example logic blocks 500, comprises the following logic blocks:

Block 502: receiving, by the server, one or more indications of a detected emergency in a building from one or more sensors distributed among one or more zones in the building, the one or more indications comprising a sensor reading level of the detected emergency and an identity of the one or more sensors;

Block 504: determining, by the server, one or more zone danger levels of the detected emergency in the one or more zones, based on the identity of the one or more sensors indicating a location in the one or more zones, and based on the sensor reading level of the detected emergency of the one or more sensors in the one or more zones;

Block 506: calculating, by the server, a route danger level of one or more evacuation routes from one or more user interfaces located in the one or more zones in the building toward one or more respective exit locations of the building, the one or more evacuation routes comprising a sequence of one or more distance segments traversing the one or more zones having respective zone danger levels, the server calculating the route danger level as a sum of products of the one or more distance segments times the respective zone danger levels of the one or more zones traversed;

Block 508: determining, by the server, one or more safest evacuation routes of the one or more evacuation routes from the one or more user interfaces respectively located in the one or more zones, the safest evacuation routes having route danger levels that are less than a route danger level of other ones of the one or more evacuation routes from the respective user interfaces;

Block 510: transmitting, by the server, one or more depictions of the safest evacuation routes to the one or more user interfaces in the one or more zones for display on one or more display devices, wherein the one or more depictions are of the one or more safest routes transmitted to respective ones of the one or more user interfaces, based on the locations of the respective ones of the one or more user interfaces relative to the one or more exit locations and the detected emergency; and Block 512: receiving, by the server, updated indications of the detected emergency in the building from the one or more sensors, and in response, determining updated zone danger levels in the one or more zones, calculating updated route danger levels based on the updated zone danger levels, determining updated safest evacuation routes based on the updated route danger levels, and transmitting updated depictions of the safest evacuation routes to the one or more user interfaces for display.

Current building automation emergency response systems are not designed to accurately determine the safest route to safety using indications of emergency received from building sensors, transmit the safest route to user interfaces for display, determine updated safest evacuation routes based on updated danger levels, and transmit the updated safest evacuation routes for display on user interfaces. This is a technical problem. An exemplary embodiment of a building automation emergency response system may comprise a processor instructed to receive, by the server, an indication of a detected emergency in a building from sensors among one or more zones in the building. The indications may comprise sensor reading levels of the detected emergency and an identity of the sensors. The processor may determine a danger zone level of the detected emergency in the one or more zones, based on the identity of the sensors indicating a location in the one or more zones, and based on the sensor reading levels of the detected emergency of the sensors in the one or more zones. The processor may calculate a route danger level of one or more evacuation routes from one or more user interfaces located in the one or more zones toward one or more respective exit locations of the building. The one or more evacuation routes may comprise a sequence of one or more distance segments traversing the one or more zones having respective zone danger levels. The processor may determine one or more safest evacuation routes of the one or more evacuation routes from the one or more user interfaces, respectively, located in the one or more zones, the safest evacuation routes having route danger levels that are less than a route danger level of other ones of the one or more evacuation routes from the respective user interfaces. The processor may transmit one or more depictions of the safest evacuation routes to the one or more user interfaces in the one or more zones for display on one or more display devices. The depictions may be of the safest routes transmitted to the respective user interfaces based on the locations of the respective user interfaces relative to the exit locations and the detected emergency. The processor may receive updated indications of the detected emergency in the building from one or more sensors, and, in response, determine updated zone danger levels in the one or more zones, calculate updated route danger levels based on the updated zone danger levels, determine updated safest evacuation routes based on the updated route danger levels, and transmit updated depictions of the safest evacuation routes to the one or more user interfaces for display. At least this foregoing combination of features comprises a building automation emergency response system that serves as a technical solution to the foregoing technical problem. This technical solution is not routine and is unconventional. This technical solution is a practical application of a building automation emergency response system that solves the foregoing technical problem and constitutes an improvement in the technical field of building-automation-system design at least by facilitating accurately determining the safest route to safety using indications of emergency received from building sensors, transmitting the safest route to user interfaces for display, determining updated safest evacuation routes based on updated danger levels, and transmitting the updated safest evacuation routes for display.

In the preceding, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

The various embodiments disclosed herein may be implemented as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to herein as a "component", "circuit," "module" or "system." Furthermore, aspects may take the form of a computer program product embodied in one or more computer-readable medium(s) having computer-readable program code embodied thereon.

Any combination of one or more computer-readable medium(s) may be utilized. The computer-readable medium may be a non-transitory computer-readable medium. A non-transitory computer-readable medium may be, for example, but not limited to, an electronic, magnetic, optical, electromagnetic, infrared, or semiconductor system, apparatus, or device, or any suitable combination of the foregoing. More specific examples (a non-exhaustive list) of the non-transitory computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages. Moreover, such computer program code can execute using a single computer system or by multiple computer systems communicating with one another (e.g., using a local area network (LAN), wide area network (WAN), the Internet, etc.). While various features in the preceding are described with reference to flowchart illustrations and/or block diagrams, a person of ordinary skill in the art will understand that each block of the flowchart illustrations and/or block diagrams, as well as combinations of blocks in the flowchart illustrations and/or block diagrams, can be implemented by computer logic (e.g., computer program instructions, hardware logic, a combination of the two, etc.). Generally, computer program instructions may be provided to a processor(s) of a general-purpose computer, special-purpose computer, or other programmable data processing apparatus. Moreover, the execution of such computer program instructions using the processor(s) produces a machine that can carry out a function(s) or act(s) specified in the flowchart and/or block diagram block or blocks.

The flowchart and block diagrams in the Figures illustrate the architecture, functionality and/or operation of possible implementations of various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

What is claimed is:

1. A method, comprising:

receiving, by a server, one or more indications of a detected emergency in a building from one or more sensors distributed among one or more zones in the building, the one or more indications comprising a sensor reading level of the detected emergency and an identity of the one or more sensors;

determining, by the server, one or more zone danger levels of the detected emergency in the one or more zones, based on the identity of the one or more sensors indicating a location in the one or more zones, and based on the sensor reading level of the detected emergency of the one or more sensors in the one or more zones;

calculating, by the server, a route danger level of one or more evacuation routes from one or more user interfaces located in the one or more zones in the building toward one or more respective exit locations of the building, each user interface configured to control operation of an HVAC system of the building, the one or more evacuation routes comprising a sequence of one or more distance segments traversing the one or more zones having respective zone danger levels;

determining, by the server, based on the one or more zone danger levels, one or more safest evacuation routes of the one or more evacuation routes from the one or more user interfaces respectively located in the one or more zones, the safest evacuation routes having route danger levels that are less than a route danger level of other ones of the one or more evacuation routes from the respective user interfaces;

transmitting, by the server, one or more depictions of the safest evacuation routes to the one or more user interfaces in the one or more zones for display on one or more display devices, wherein the one or more depictions are of the one or more safest routes transmitted to respective ones of the one or more user interfaces, based on the locations of the respective ones of the one or more user interfaces relative to the one or more exit locations and the detected emergency; and receiving, by the server, updated indications of the detected emergency in the building from the one or more sensors, and in response, determining updated zone danger levels in the one or more zones, calculating updated route danger levels based on the updated zone danger levels, determining updated safest evacuation routes based on the updated route danger levels, and transmitting updated depictions of the safest evacuation routes to the one or more user interfaces for display;

wherein the one or more sensors comprise a plurality of sensors and the one or more zones comprise a plurality of predefined zones, each zone defined by at least one sensor in the building and at least one zone defined by multiple sensors in the building, the method further comprising:

maintaining, by the server, a record of past indications comprising past instances of sensor reading level of the detected emergency and the identity of the one or more sensors in the one of the one or more zones;

determining, by the server, weights for the past instances of sensor reading level of the detected emergency of the one or more sensors in the one or more zones, the weights based on how frequently and recently the past instances of sensor reading level of the detected emergency have been detected by the one or more sensors;

calculating, by the server, a past sensor danger level of the detected emergency in the one or more zones;

calculating, by the server, a past-present-zone danger level of the one or more zones based on the received sensor reading level and the past sensor danger level of the one or more zones;

calculating, by the server, a past-present route danger level of one or more evacuation routes from one or more user interfaces located in the one or more zones in the building, based on the past-present-zone danger level of the one or more zones; and determining, by the server, the safest evacuation route of the one or more evacuation routes from the one or more user interfaces located in the one or more zones, based on the past-present route danger level of one or more evacuation routes;

determining, by the server, a predicted sensor danger level of the detected emergency at the one or more sensors, based on a predicted rate of movement of the emergency or on conditions of the zones;

determining, by the server, a predicted zone danger level of the detected emergency in the one or more zones, based on the predicted sensor danger level of the detected emergency of the one or more sensors in the one or more zones;

calculating, by the server, a past-present-predicted zone danger level of the one or more zones by adding the past-present zone danger level and the predicted zone danger level of the one or more zones; and calculating, by the server, the safest evacuation route based on the past-present-predicted zone danger level of the one or more zones.

2. The method of claim 1, wherein when the sensor for detecting an emergency is at least one of a gunshot sensor, a fire sensor, an explosion sensor, a hazardous materials release sensor, a natural gas leak sensor, a smoke sensor, a plumbing flooding sensor, a power failure sensor, or an elevator failure sensor.

3. The method of claim 1, wherein the server calculates the route danger level as a sum of products of the one or more distance segments times the respective zone danger levels of the one or more zones traversed.

4. The method of claim 1, wherein the server calculates the zone danger level by allocating a different weight to the one or more sensors based on the type of sensor.

5. A method, comprising:

receiving, by a server, one or more indications of a detected emergency in a building from one or more sensors distributed among one or more zones in the building, the one or more indications comprising a sensor reading level of the detected emergency and an identity of the one or more sensors;

determining, by the server, one or more zone danger levels of the detected emergency in the one or more zones, based on the identity of the one or more sensors indicating a location in the one or more zones, and based on the sensor reading level of the detected emergency of the one or more sensors in the one or more zones;

calculating, by the server, a route danger level of one or more evacuation routes from one or more user interfaces located in the one or more zones in the building toward one or more respective exit locations of the building, each user interface configured to control operation of an HVAC system of the building, the one or more evacuation routes comprising a sequence of one or more distance segments traversing the one or more zones having respective zone danger levels;

determining, by the server, based on the one or more zone danger levels, one or more safest evacuation routes of the one or more evacuation routes from the one or more user interfaces respectively located in the one or more zones, the safest evacuation routes having route danger levels that are less than a route danger level of other ones of the one or more evacuation routes from the respective user interfaces;

transmitting, by the server, one or more depictions of the safest evacuation routes to the one or more user interfaces in the one or more zones for display on one or more display devices, wherein the one or more depictions are of the one or more safest routes transmitted to respective ones of the one or more user interfaces, based on the locations of the respective ones of the one or more user interfaces relative to the one or more exit locations and the detected emergency; and receiving, by the server, updated indications of the detected emergency in the building from the one or more sensors, and in response, determining updated zone danger levels in the one or more zones, calculating updated route danger levels based on the updated zone danger levels, determining updated safest evacuation routes based on the updated route danger levels, and transmitting updated depictions of the safest evacuation routes to the one or more user interfaces for display;

wherein the one or more sensors comprise a plurality of sensors and the one or more zones comprise a plurality of predefined zones, each zone defined by at least one sensor in the building and at least one zone defined by multiple sensors in the building, the method further comprising:

determining, by the server, a predicted sensor danger level of the detected emergency at the one or more sensors, based on a predicted rate of movement of the emergency or on conditions of the zones;

determining, by the server, a predicted zone danger level of the detected emergency in the one or more zones, based on the predicted sensor danger level of the detected emergency of the one or more sensors in the one or more zones;

calculating, by the server, a present-predicted zone danger level of the one or more zones by adding the present zone danger level and the predicted zone danger level of the one or more zones; and calculating, by the server, the safest evacuation route based on the present-predicted zone danger level of the one or more zones.

6. The method of claim 5, wherein when the sensor for detecting an emergency is at least one of a gunshot sensor, a fire sensor, an explosion sensor, a hazardous materials release sensor, a natural gas leak sensor, a smoke sensor, a plumbing flooding sensor, a power failure sensor, or an elevator failure sensor.

7. The method of claim 5, wherein the server calculates the route danger level as a sum of products of the one or more distance segments times the respective zone danger levels of the one or more zones traversed.

8. The method of claim 5, wherein the server calculates the zone danger level by allocating a different weight to the one or more sensors based on the type of sensor.

9. A method, comprising:

receiving, by a server, one or more indications of a detected emergency in a building from one or more sensors distributed among one or more zones in the building, the one or more indications comprising a sensor reading level of the detected emergency and an identity of the one or more sensors;

determining, by the server, one or more zone danger levels of the detected emergency in the one or more zones, based on the identity of the one or more sensors indicating a location in the one or more zones, and based on the sensor reading level of the detected emergency of the one or more sensors in the one or more zones;

calculating, by the server, a route danger level of one or more evacuation routes from one or more user interfaces located in the one or more zones in the building toward one or more respective exit locations of the building, each user interface configured to control operation of an HVAC system of the building, the one or more evacuation routes comprising a sequence of one or more distance segments traversing the one or more zones having respective zone danger levels;

determining, by the server, based on the one or more zone danger levels, one or more safest evacuation routes of the one or more evacuation routes from the one or more user interfaces respectively located in the one or more zones, the safest evacuation routes having route danger levels that are less than a route danger level of other ones of the one or more evacuation routes from the respective user interfaces;

transmitting, by the server, one or more depictions of the safest evacuation routes to the one or more user interfaces in the one or more zones for display on one or more display devices, wherein the one or more depictions are of the one or more safest routes transmitted to respective ones of the one or more user interfaces, based on the locations of the respective ones of the one or more user interfaces relative to the one or more exit locations and the detected emergency; and receiving, by the server, updated indications of the detected emergency in the building from the one or more sensors, and in response, determining updated zone danger levels in the one or more zones, calculating updated route danger levels based on the updated zone danger levels, determining updated safest evacuation routes based on the updated route danger levels, and transmitting updated depictions of the safest evacuation routes to the one or more user interfaces for display;

wherein the one or more sensors comprise a plurality of sensors and the one or more zones comprise a plurality of predefined zones, each zone defined by at least one sensor in the building and at least one zone defined by multiple sensors in the building, the method further comprising:

calculating, by the server, a first evacuation route commencing from one or more user interfaces distributed among respective ones of the one or more zones in the building, the one or more user interfaces including a display device, the evacuation route calculated to traverse a first sequence of respective ones of the one or more zones having a first route danger level;

calculating, by the server, a second evacuation route commencing from one or more user interfaces distributed among respective ones of the one or more zones in the building, the one or more user interfaces including a display device, the evacuation route calculated to traverse a second sequence of respective ones of the one or more zones having a second route danger level;

determining, by the server, that the first evacuation route having the first route danger level is safer than the second evacuation route having the second route danger level; and transmitting, by the server, a depiction of the first evacuation route to a respective one of the one or more user interfaces for display on the display device as the safest evacuation route.

10. The method of claim 9, wherein when the sensor for detecting an emergency is at least one of a gunshot sensor, a fire sensor, an explosion sensor, a hazardous materials release sensor, a natural gas leak sensor, a smoke sensor, a plumbing flooding sensor, a power failure sensor, or an elevator failure sensor.

11. The method of claim 9, wherein the server calculates the route danger level as a sum of products of the one or more distance segments times the respective zone danger levels of the one or more zones traversed.

12. The method of claim 9, wherein the server calculates the zone danger level by allocating a different weight to the one or more sensors based on the type of sensor.

* * * * *